US008662648B2

(12) United States Patent
Kamiyanagi et al.

(10) Patent No.: US 8,662,648 B2
(45) Date of Patent: Mar. 4, 2014

(54) LIQUID CONSUMPTION APPARATUS

(71) Applicant: Seiko Epson Corporation, Tokyo (JP)

(72) Inventors: Masashi Kamiyanagi, Nagano-ken (JP); Yuichi Nishihara, Nagano-ken (JP); Junpei Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/663,761

(22) Filed: Oct. 30, 2012

(65) Prior Publication Data

US 2013/0114084 A1 May 9, 2013

(30) Foreign Application Priority Data

Nov. 9, 2011 (JP) ..... 2011-245115

(51) Int. Cl.
*B41J 2/175* (2006.01)

(52) U.S. Cl.
USPC ..... 347/86

(58) Field of Classification Search
USPC ..... 347/86
See application file for complete search history.

(56) References Cited

U.S. PATENT DOCUMENTS

| | | | | |
|---|---|---|---|---|
| 6,361,136 | B1 * | 3/2002 | Watanabe et al. | 347/7 |
| 7,918,547 | B2 * | 4/2011 | Hatasa et al. | 347/86 |
| 2009/0219310 | A1 | 9/2009 | Kondo | |

FOREIGN PATENT DOCUMENTS

| | | | | |
|---|---|---|---|---|
| JP | 10-232157 | A | 9/1998 | |
| JP | 2000-108367 | A | 4/2000 | |
| JP | 2002-264355 | * | 3/2001 | B41J 2/175 |
| JP | 2002-264355 | A | 9/2002 | |
| JP | 2002-273899 | A | 9/2002 | |
| JP | 2002-292888 | A | 10/2002 | |
| JP | 2002-370372 | A | 12/2002 | |
| JP | 2009-208297 | A | 9/2009 | |

* cited by examiner

*Primary Examiner* — Matthew Luu
*Assistant Examiner* — Michael Konczal

(57) ABSTRACT

A liquid consumption apparatus includes a detection portion in which a light emitting portion and a light receiving portion are arranged, a liquid container that houses a liquid and in which a prism having a cavity is disposed, a carriage with respect to which the liquid container is attachable and detachable, and in which an opening is provided in a position that opposes the prism, and a light shielding portion disposed in the opening in the carriage. When a driving portion moves the carriage in a direction in which the light emitting portion and the light receiving portion are arranged, noise light produced by the prism bottom surface or cavity portion is suppressed, as a result of the light shielding portion blocking part of irradiated light.

9 Claims, 17 Drawing Sheets

180
170
170a
170b
171
M
50
90
92
94
L
211
213
214
201
203
Y AXIS
+
0
-

LIQUID CONSUMPTION APPARATUS

CROSS REFERENCE TO RELATED APPLICATIONS

The entire disclosure of Japanese Patent Application No. 2011-245115, filed on Nov. 9, 2011 is expressly incorporated herein by reference.

BACKGROUND

1. Technical Field

The present invention relates to liquid consumption apparatuses.

2. Related Art

Printing apparatuses using an inkjet system, which are an example of a liquid consumption apparatus, are fitted with ink cartridges, which are removable liquid containers. There are ink cartridges that are provided with a prism for detecting that the amount of ink in the ink cartridge has fallen below a predetermined amount. Detection of the residual state of ink using a prism can be performed based, for instance, on the intensity level of light that is incident on a light receiving element, utilizing the fact that when light irradiated by a light emitting element is incident on the prism and reflected by the sloped surfaces at the apex of the prism, the reflective state differs depending on whether the sloped surfaces are in contact with ink.

In JP-A-10-232157, in order to prevent light that has passed through the prism and into the ink inside the ink cartridge from again being incident on the prism and received by the light receiving element after being reflected by the interface between the upper ink surface and air in the ink cartridge, technology is disclosed for installing a structure for suppressing reflection by the interface between the upper ink surface and air inside the ink cartridge. However, there are cases where reflection is produced not only by the interface between the upper ink surface and air in the ink cartridge but also by the surface of the prism on which the light is incident. Such reflection cannot be suppressed with the technology disclosed in JP-A-10-232157.

JP-A-10-232157 and JP-A-2002-264355 are examples of related art.

SUMMARY

An advantage of some aspects of the invention is to provide technology for suppressing reflection produced by a surface of a prism on which light is incident, and for more accurately detecting a residual state of a liquid.

The invention was made in order to solve at least some of the above-mentioned problems, and can be realized as the following embodiments or application examples.

APPLICATION EXAMPLE 1

According to an aspect of the invention, a liquid consumption apparatus includes a detection portion in which a light emitting portion and a light receiving portion are disposed in line, a liquid container that houses a liquid and in which a prism that reflects light irradiated by the light emitting portion toward the light receiving portion according to an amount of the liquid in the liquid container is disposed, a carriage with respect to which the liquid container is attachable and detachable, and in which an opening is provided in a position that opposes the prism when the liquid container is attached, a driving portion that moves the carriage in the direction in which the light emitting portion and the light receiving portion are arranged in line, and a light shielding portion disposed in the opening provided in the carriage.

With such a liquid consumption apparatus, because an opening is provided in a position of the carriage opposing the prism and a light shielding portion is disposed in the opening, the light shielding portion is able to block part of the light irradiated by the light emitting portion, when the carriage moves in the direction in which the light emitting portion and the light receiving portion are arranged in line. Thus, light reflected by the bottom surface of the prism can be suppressed and the judgment accuracy of the residual state of liquid in the liquid container can be improved.

APPLICATION EXAMPLE 2

With the liquid consumption apparatus according to application example 1, it may be preferable that the light shielding portion divides the opening in a direction intersecting the direction in which the carriage moves. With such a liquid consumption apparatus, because the light shielding portion is provided so as to divide the opening of the carriage, the position of the light shielding portion does not shift relative to the carriage even when the carriage moves. Also, even if the positional relationship between the prism and the detection portion shifts in a direction intersecting the direction in which the carriage moves, the light shielding portion is able to block part of the light irradiated by the light emitting portion. Thus the judgment accuracy of the residual state of liquid in the liquid container can be further improved.

APPLICATION EXAMPLE 3

With the liquid consumption apparatus according to application example 1, it may be preferable that the prism is provided with a cavity portion in a central portion of a surface that opposes the detection portion, and that a width of the light shielding portion in the direction in which the carriage moves is greater than a width of the cavity portion in the direction in which the carriage moves. With such a liquid consumption apparatus, even if a cavity portion for suppressing deformation at the time of prism formation is provided in a central portion of the surface of the prism that opposes the detection portion, light reflected by the cavity portion can be suppressed because the width of the light shielding portion in the direction in which the carriage moves is greater than the width of the cavity portion.

APPLICATION EXAMPLE 4

With the liquid consumption apparatus according to application example 1, it may be preferable that a surface of the light shielding portion that opposes the detection portion is a sloped surface that slopes toward a bottom surface of the liquid container. With such a liquid consumption apparatus, light that is incident on the light shielding portion can be reflected in a different direction from a light receiving portion by the sloped surface of the light shielding portion. Accordingly, incidence of light reflected by the light shielding portion on the light receiving portion can be suppressed.

APPLICATION EXAMPLE 5

With the liquid consumption apparatus according to application example 4, it may be preferable that the sloped surface with which the light shielding portion is provided slopes to the light emitting portion side, when the light shielding portion and the detection portion are opposed to each other. With such a liquid consumption apparatus, because light reflected by the sloped surface with which the light shielding portion is provided is reflected to the light emitting portion side, incidence of light reflected by the light shielding portion on the light receiving portion can be more effectively suppressed.

APPLICATION EXAMPLE 6

With the liquid consumption apparatus according to application example 1, it may be preferable that a surface of the light shielding portion that opposes the detection portion protrudes toward the detection portion from a surface of the carriage that opposes the detection portion. With such a liquid consumption apparatus, since the surface of the light shielding portion that opposes the detection portion is close to the light emitting portion and the light receiving portion of the detection portion, the range over which the light shielding portion is able to suppress light reflected by the bottom surface or the cavity portion of the prism can be increased.

APPLICATION EXAMPLE 7

With the liquid consumption apparatus according to application example 1, it may be preferable that a surface of the light shielding portion that opposes the detection portion has at least two sloped surfaces, and that the at least two sloped surfaces are symmetrical around a direction intersecting the direction in which the carriage moves. With such a liquid consumption apparatus, since the surfaces of the light shielding portion that opposes the detection portion are symmetrical in shape, the range over which the light shielding portion is able to suppress light reflected by the bottom surface or the cavity portion of the prism can also be made symmetrical around the center of the prism. Accordingly, setting of the range over which the residual state of a liquid can be detected will be facilitated.

APPLICATION EXAMPLE 8

With the liquid consumption apparatus according to application example 1, it may be preferable that the carriage includes a reflection plate, and that the detection portion irradiates the reflection plate with light using the light emitting portion, receives light reflected by the reflection plate with the light receiving portion, and detects a fault in the detection portion based on the reflected light that is received. With such a liquid consumption apparatus, faults in the detection portion can be detected utilizing light that is noise light, being light reflected by the bottom surface or the cavity portion of the prism, at the time of residual amount detection using the prism.

Apart from the above-mentioned configuration as a liquid consumption apparatus, the invention can also be configured as a control method of a liquid consumption apparatus, a printing method using a liquid consumption apparatus, and a computer program for performing the above control and printing. The computer program may be recorded on a computer-readable recording medium. As for the recording medium, various media such as flexible disk, CD-ROM, DVD-ROM, magneto-optical disk, memory card, hard disk or the like, for example, can be utilized.

DESCRIPTION OF EXEMPLARY EMBODIMENTS

Figure 1:
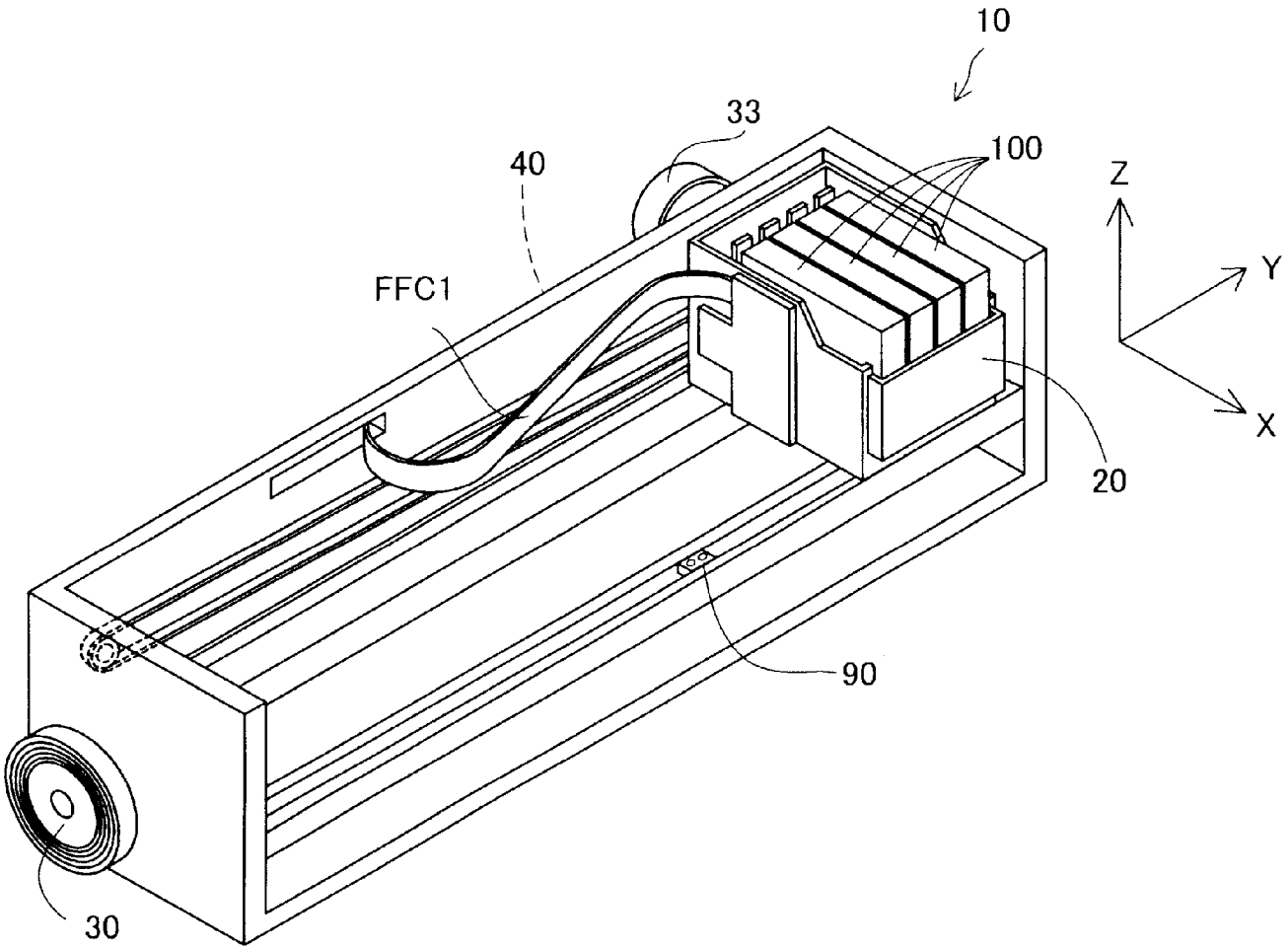
FIG. 1 is a perspective diagram showing a principal portion of a printing apparatus serving as an embodiment of the invention.
Figure 2:
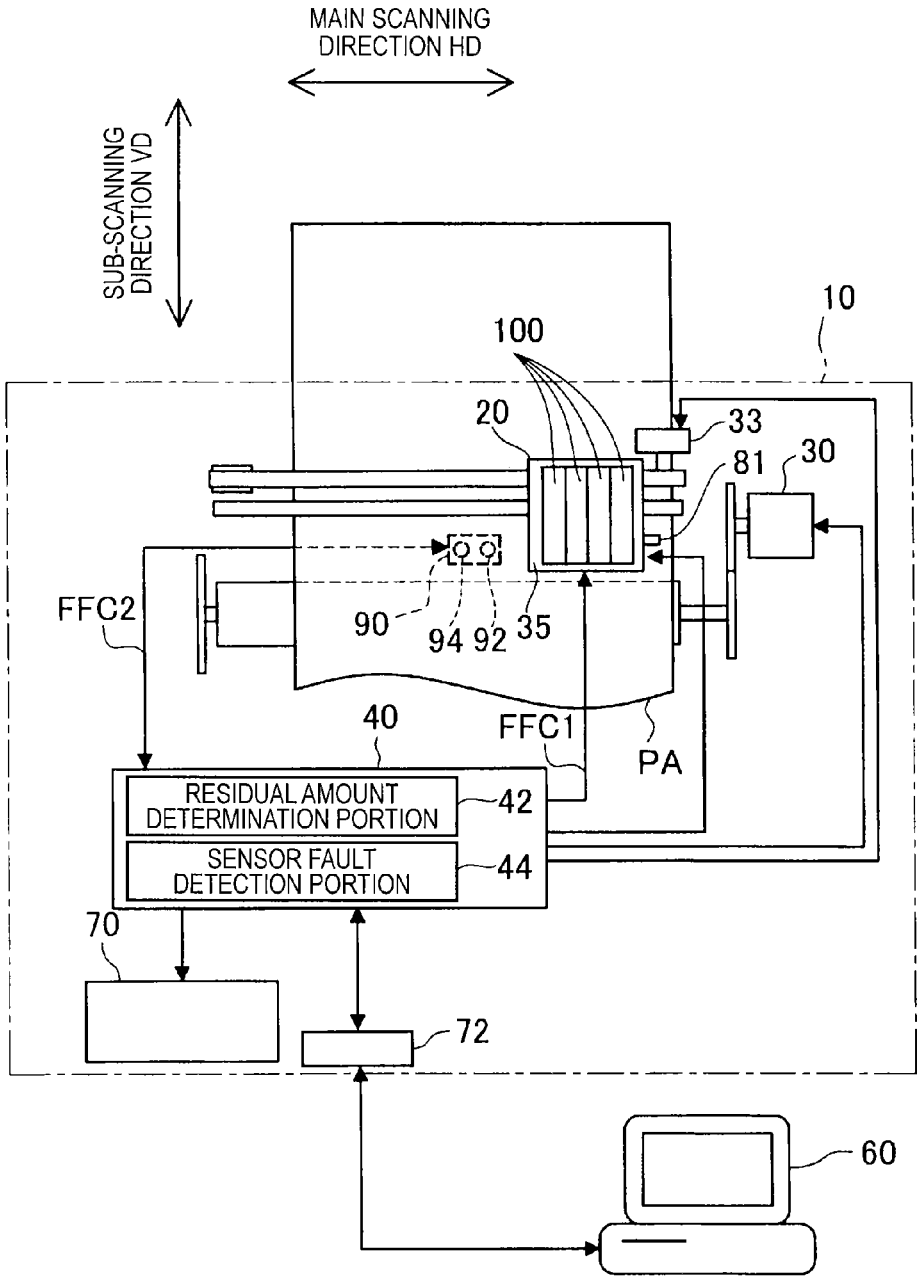
FIG. 2 is a schematic configuration diagram of the printing apparatus.

A. First Embodiment:

A-1. Configuration of Printing Apparatus:

FIG. 1 is a perspective diagram showing a principal portion of a printing apparatus 10 as an embodiment of the invention. FIG. 2 is a schematic configuration diagram of the printing apparatus 10. In FIG. 1, mutually orthogonal axes X, Y and Z are depicted. The X, Y and Z axes are also given as necessary in diagrams shown hereafter. In the present embodiment, with regard to the use posture of the printing apparatus 10, the Z-axis direction is the vertical direction, and the surface of the printing apparatus in the X-axis direction is the front surface. A main scanning direction of the printing apparatus 10 is the Y-axis direction, and a sub-scanning direction is the X-axis direction. The printing apparatus 10 serving as a liquid consumption apparatus is fitted with ink cartridges 100 in which is housed ink IK of one color each, such as cyan, magenta, yellow and black, and includes a carriage 20 that is provided with a fault detection plate 81, a carriage motor 33 that drives the carriage 20 in a main scanning direction HD, a detection portion 90 disposed in parallel with the main scanning direction HD of the carriage 20 and for detecting a residual state of ink, a paper feed motor 30 that conveys a print medium PA in a sub-scanning direction VD, a printing head 35 that is mounted in the carriage 20 and discharges ink IK supplied from the ink cartridges 100, and a control unit 40 that controls the carriage motor 33, the paper feed motor 30 and the printing head 35 to perform printing, based on print data received from a computer 60 or the like connected via a predetermined interface 72. A display panel 70 on which operating states of the printing apparatus 10 and the like are displayed is connected to the control unit 40. Also, the carriage 20 and the detection portion 90 are respectively connected to the control unit 40 with a cable FFC1 and a cable FFC2.

Figure 3:
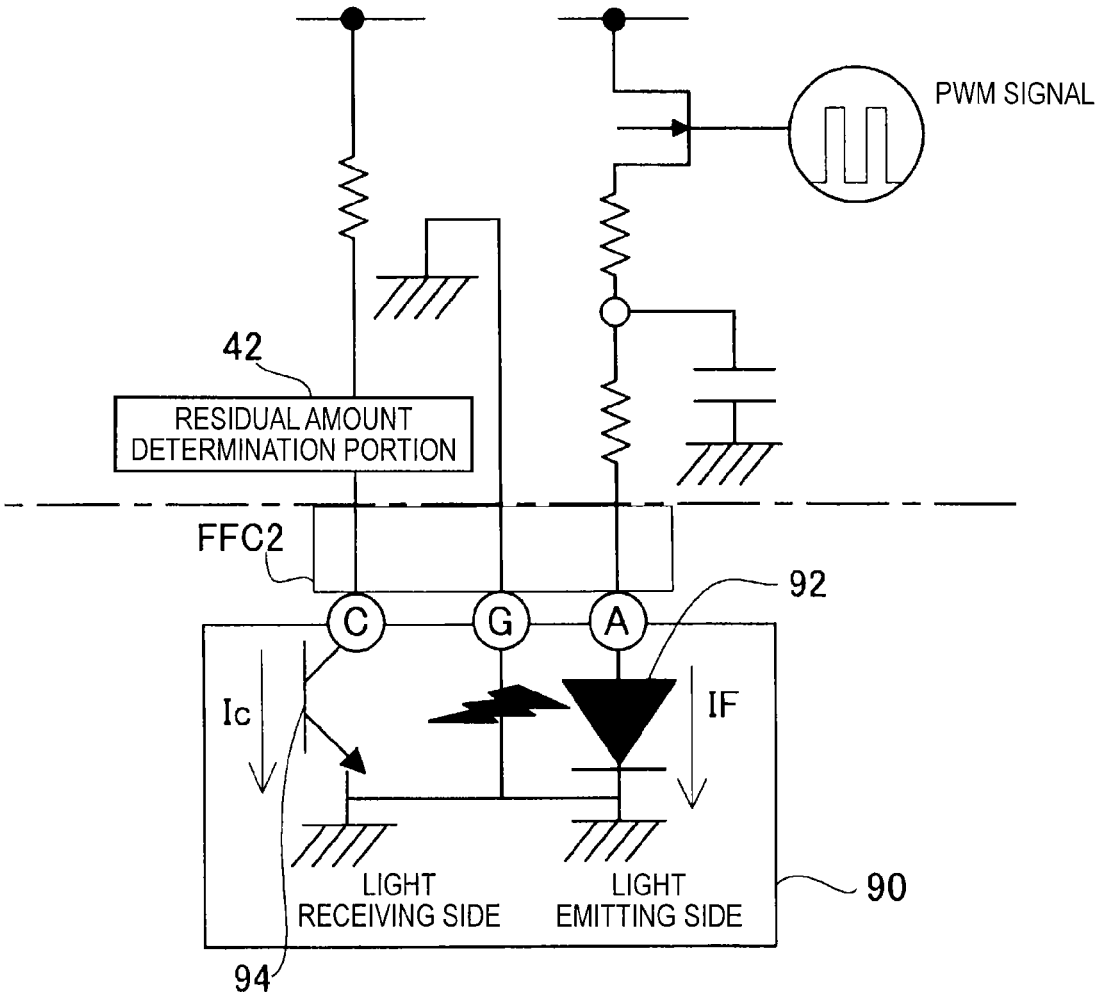
FIG. 3 is an illustrative diagram showing an electrical configuration of a detection portion.

FIG. 3 is an illustrative diagram showing an electrical configuration of the detection portion 90. The detection portion 90 is provided with a light emitting element 92 and a light receiving element 94. The light emitting element 92 irradiates light, and the light receiving element 94 receives light. The detection portion 90 is constituted by a reflective photo-interrupter. The detection portion 90 is provided with, for example, an LED (Light Emitting Diode) as the light emitting element 92, and is provided with, for example, a photo-transistor as the light receiving element 94. The detection portion 90 adjusts the duty ratio (proportion of ON time and OFF time) of a PWM (Pulse Width Modulation) signal to cause the LED to emit light. Light emitted by the LED is incident on the photo-transistor after being reflected by a prism in the ink cartridges 100 which will be discussed later, and is thereafter converted to a current value.

The light emitting element 92 and the light receiving element 94 provided in the detection portion 90 are disposed in line, in parallel with the main scanning direction HD of the carriage 20 (FIG. 2). Also, the light emitting element 92 and the light receiving element 94 are disposed so as to oppose a prism 170 in the ink cartridges 100 via an opening 21 provided in the carriage 20, when the carriage 20 is driven by the carriage motor 33 and positioned over the light emitting element 92 and the light receiving element 94 provided in the detection portion 90. The opening 21 and the prism 170 will be discussed later.

The control unit 40 is provided with a residual amount determination portion 42 and a sensor fault detection portion 44. The control unit 40 is provided with a CPU, and functions as the residual amount determination portion 42 and the sensor fault detection portion 44, by expanding a control program prestored in ROM in RAM and executing the expanded control program. Also, the control unit 40 controls the reciprocation of the carriage 20 and the paper feed, and also controls the drive of the printing head 35 by functioning as a drive control portion to control the discharge of ink IK onto the print medium PA.

The residual amount determination portion 42 is a functional portion that judges whether the residual amount of ink IK in the ink cartridges 100 is greater than a predetermined amount or less than or equal to a predetermined amount. The residual amount determination portion 42 acquires a current value based on light incident on the photo-transistor through the cable FFC2, and judges whether the residual amount of ink IK in the ink cartridges 100 is less than or equal to the predetermined amount based on the acquired current value. A state in which the residual amount of ink IK is less than or equal to the predetermined amount but has not completely run out will also be referred to hereafter as the "ink being near the end". Specifically, when the current value acquired through the cable FFC2 exceeds a current value corresponding to a predetermined residual amount of ink, the residual amount determination portion 42 judges that the residual amount of ink IK is near the end.

The residual amount determination portion 42 judges whether the residual amount of ink IK is near the end for each of the ink cartridges 100 when the carriage 20 moves over the detection portion 90 at a predetermined timing, such as when the printing apparatus 10 is started up, at the end of a print job onto the print medium PA, or during execution of printing, for example. When the residual amount determination portion 42 has judged that the residual amount of ink IK is near the end, the control unit 40 outputs information or an instruction for displaying the fact that the residual amount of an ink cartridge is low or for performing a display prompting replacement of the ink cartridge 100 to the display panel 70 connected to the control unit 40 or to the interface 72.

The sensor fault detection portion 44 is a functional portion that judges whether the detection portion 90 is operating normally. The sensor fault detection portion 44 moves the fault detection plate 81 provided in the carriage 20 over the detection portion 90 and detects faults in the detection portion 90, prior to the timing at which the residual amount determination portion 42 judges whether the residual amount of ink IK is greater than the predetermined amount or less than or equal to the predetermined amount, for example. The sensor fault detection portion 44 and the fault detection plate 81 will be discussed in detail later.

Figure 4:
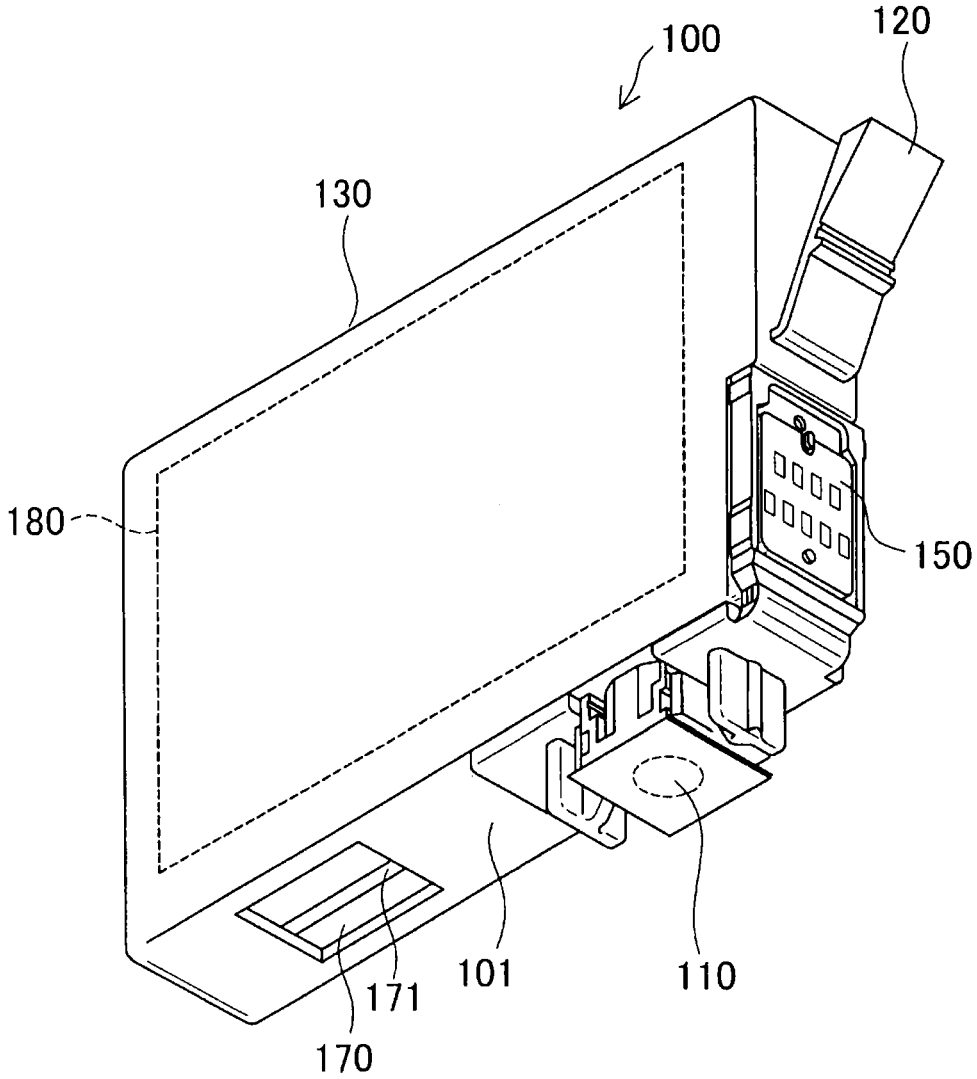
FIG. 4 is a perspective diagram of an ink cartridge.

A-2. Configuration of Cartridge:

FIG. 4 is a perspective diagram of an ink cartridge 100. The ink cartridge 100 is provided with an approximately rectangular parallelepiped ink housing portion 130 that houses ink IK serving as the liquid, a substrate 150 on which a memory that stores information relating to the ink cartridge 100 is mounted, and a lever 120 for attaching and detaching the ink cartridge 100 with respect to the carriage 20. An ink feeding port 110 into which an ink supply needle (not shown) provided in the carriage 20 is inserted when the ink cartridge 100 is fitted in the carriage 20 is formed on a bottom surface 101 of the ink cartridge 100 (surface corresponding to a −Z direction of the ink cartridge 100 when fitted in the carriage 20 provided in the printing apparatus 10). Prior to use, the opening of the ink feeding port 110 is sealed by a film.

Figure 5:
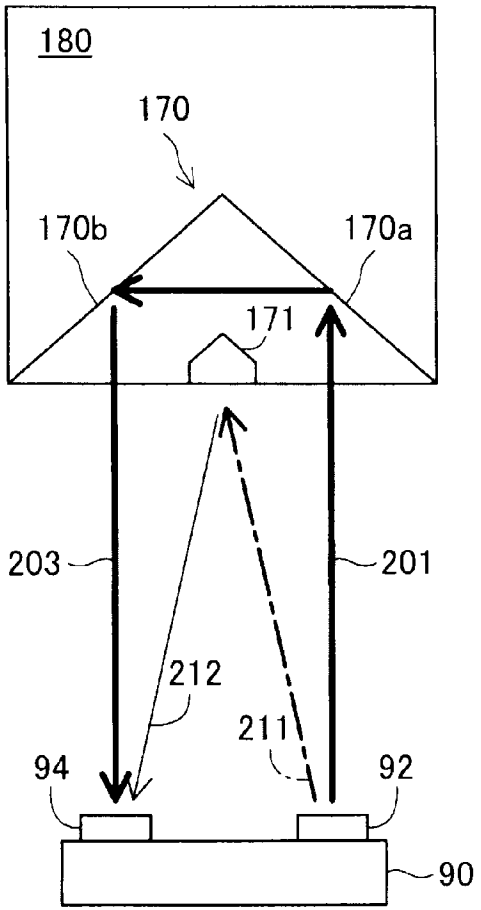
FIG. 5 is a schematic diagram for illustrating the reflection of light by a prism, in the case where there is no ink in an ink chamber.

The ink housing portion 130 is provided with an ink chamber 180 that houses ink IK inside. As shown in FIG. 5, an isosceles right-angled triangular prism 170 whose apex angle is formed by two sloped surfaces 170*a* and 170*b* is disposed on a bottom surface inside the ink chamber 180 in the −Z direction. The prism 170 is provided on the bottom surface 101 of the ink cartridge 100. Once these ink cartridges 100 are fitted in the carriage 20 from above, ink IK can be supplied from the ink cartridges 100 to the printing head 35.

A-3. Residual Ink Amount Detection by Prism:

FIG. 5 is a schematic diagram for illustrating the reflection of light by the prism 170 provided in the ink chamber 180 of the ink cartridge 100 in the case where there is no ink in the ink chamber 180. The prism 170 is formed by polypropylene so as to be transparent. Also, a cavity portion 171 (recessed portion) is provided in a center portion of the bottom surface of the prism 170, in order to suppress deformation (sink marks) produced when forming the prism 170. Note that the "bottom surface" of the prism 170 denotes the surface opposing the apex angle of the prism. With the prism 170, the reflective state of light differs depending on the refractive index of the fluid in contact with the sloped surfaces 170*a* and 170*b*. Specifically, as shown in FIG. 5, in the case where the sloped surfaces 170*a* and 170*b* contact air, or in other words, in the case where the amount of ink IK is low, light irradiated toward the sloped surface 170*a* of the prism 170 by the light emitting element 92 provided in the detection portion 90 (light path 201) is reflected by the sloped surface 170*a* of the prism 170, due to the difference in refractive index between the prism 170 and air. This reflected light is incident on the light receiving element (light path 203) after being further reflected by the other sloped surface 170*b*. In other words, the direction in which incident light from the light emitting element 92 advances is reversed 180 degrees and ejected to the light receiving element 94, due to light being reflected twice in total inside the prism 170.

Figure 6:
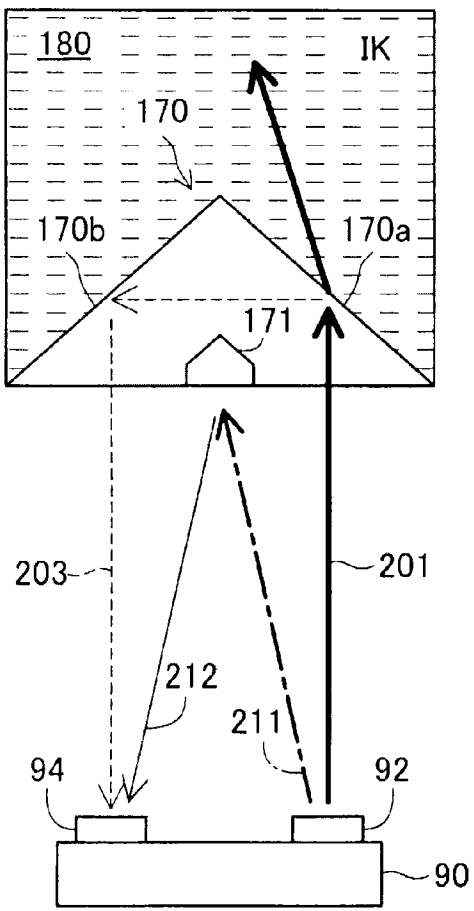
FIG. 6 is a schematic diagram for illustrating the reflection of light by the prism, in the case where there is sufficient ink in the ink chamber.

FIG. 6 is a schematic diagram for illustrating the reflection of light by the prism 170 provided in the ink chamber 180 of the ink cartridge 100 in the case where there is sufficient ink IK in the ink chamber 180. In the case where there is enough ink IK in the ink chamber 180 for the sloped surfaces 170*a* and 170*b* to contact the ink IK, as shown in FIG. 6, since the refractive indices of the prism 170 and the ink IK are comparable, most of the light irradiated by the light emitting element 92 (light path 201) is refracted by the sloped surface 170*a* as shown in FIG. 6, and absorbed within the ink IK. Accordingly, the amount of the light that is incident on the light receiving element 94 (light path 203) after being reflected by the sloped surface 170*b* is very small when compared with the case shown in FIG. 5 where the amount of the ink is low.

Incidentally, there are cases where the light that is incident on the light receiving element 94 includes light other than the above-mentioned light reflected by the sloped surface 170*b* of the prism 170 (light path 203). In the case where light irradiated by the light emitting element 92 provided in the detection portion 90 has a wide directivity and is not only perpendicularly incident on the bottom surface of the prism 170 shown in FIG. 5 and FIG. 6 (light path 201), the light emitting element 92 also irradiates light such as a light path 211 shown in FIG. 5 and FIG. 6, for example. In such a case, since the cavity portion 171 or the bottom surface of the prism 170 is also irradiated with light (light path 211), part of the irradiated light is reflected by the cavity portion 171 or the bottom surface of the prism 170 and is incident on the light receiving element 94 (light path 212). Light (hereinafter, noise light) that differs from light that is incident on the light receiving element 94 after being reflected by the sloped surface 170*b* of the prism 170 (light path 203) is thus not light arising from the amount of ink IK in the ink chamber 180. Accordingly, the determination of whether the ink is near the end may be affected.

Moreover, since the positional relationship between the detection portion 90 and the prism 170 that is provided in the ink cartridges 100 fitted in the carriage changes relatively due to the reciprocation of the carriage 20, the amount of noise light is not necessarily constant. Thus, the determination of whether the ink is near the end could also be affected by this factor.

Figure 7A:
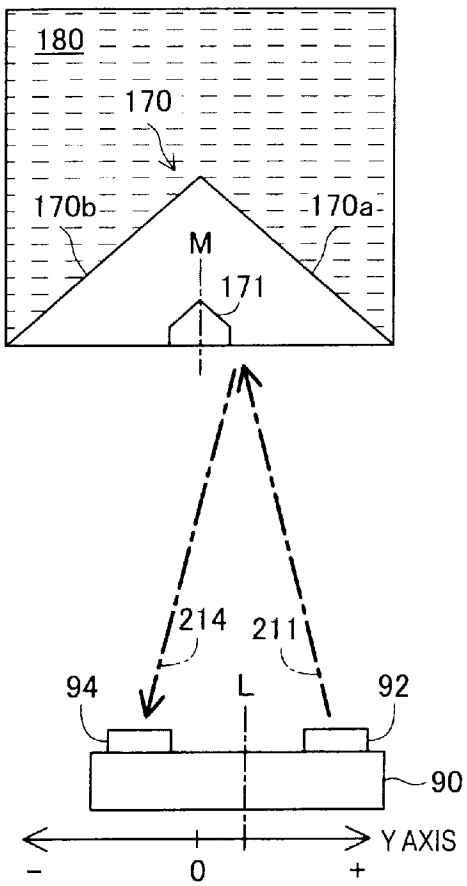
FIGS. 7A to 7C are for illustrating noise light produced by changes in the positional relationship of the prism and the detection portion.
Figure 7B:
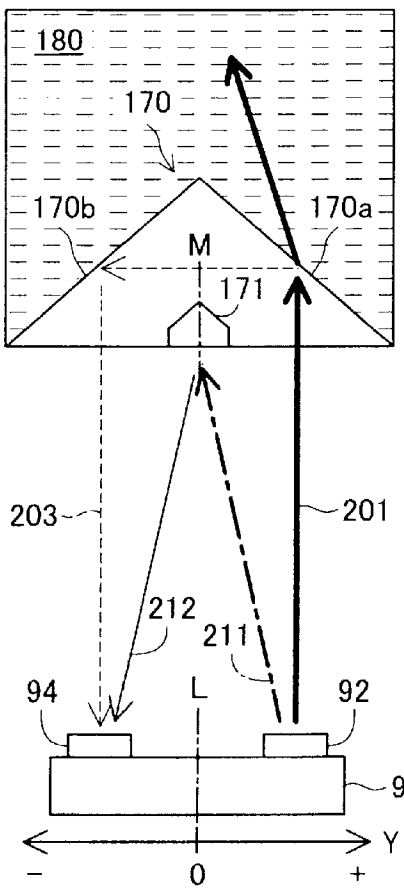
Figure 7C:
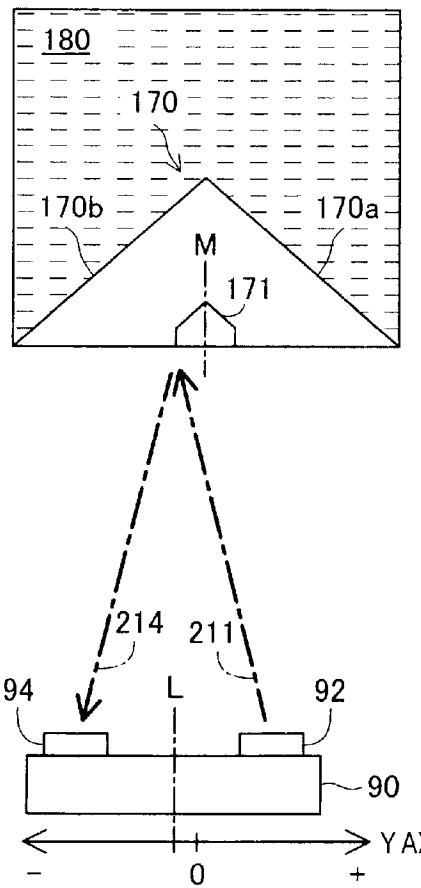

FIGS. 7A to 7C are for illustrating the noise light produced by changes in the positional relationship of the prism 170 and the detection portion 90. In FIGS. 7A to 7C, the Y-axis is an axis that passes through the light emitting element 92 and the light receiving element 94 of the detection portion 90 that are disposed in parallel with the main scanning direction HD of the carriage 20. Also, in FIGS. 7A to 7C, "Y=0" represents the fact that the prism 170 is in the following positional relationship with the light emitting element 92 and the light receiving element 94 provided in the detection portion 90. First, let the perpendicular line drawn toward the Y-axis from a ridge line of the prism, which is the line of intersection formed by the sloped surface 170*a* and the sloped surface 170*b*, be a "prism centerline M". Next, let the perpendicular line drawn through the Y-axis from the center between the light emitting element 92 and the light receiving element 94 provided in the detection portion 90 (perpendicular line passing centrally between the center of a light emitting portion of the light emitting element 92 and the center of a light receiving portion of the light receiving element 94 provided in the detection portion 90) be a "sensor centerline L". "Y=0" represents the position at which this prism centerline M coincides with the sensor centerline L. In FIGS. 7A to 7C, the side on which the light emitting element 92 exists when Y=0 is the plus side of the Y-axis, and the side on which the light receiving element 94 exists is the minus side of the Y-axis. Note that although the carriage 20 is moved by the motor 30 in the printing apparatus 10, in the subsequent description assume for the sake of description that the position of the prism centerline M is fixed at "Y=0" and the sensor centerline L is moved relatively. The change in noise light produced by changes in the relative positional relationship of the prism 170 with the light emitting element 92 and the light receiving element 94 provided in the detection portion 90 at this time will be described.

In the case where the sensor centerline L is positioned on the minus side of the cavity portion 171, as shown in FIG. 7A, reflected light from the bottom surface of the prism 170 (light path 214) is incident on the light receiving element 94 as noise light. In the case where the sensor centerline L is on the inner side of the cavity portion 171, as shown in FIG. 7B, reflected light from the cavity portion 171 (light path 212) is incident on the light receiving element 94. Then, when the sensor centerline L is positioned on the plus side of the cavity portion 171, as shown in FIG. 7C, reflected light from the bottom surface of the prism 170 (light path 214) will again be incident on the light receiving element 94. The circumstances under which noise light is produced thus change depending on the positional relationship between the prism centerline M and the sensor centerline L. When a large amount of such noise light is superimposed on the light for determining whether the ink is near the end (e.g., light of the light path 203 shown in FIG. 7B), the residual amount determination portion 42 will have difficulty accurately judging that the ink IK is near the end.

Figure 8:
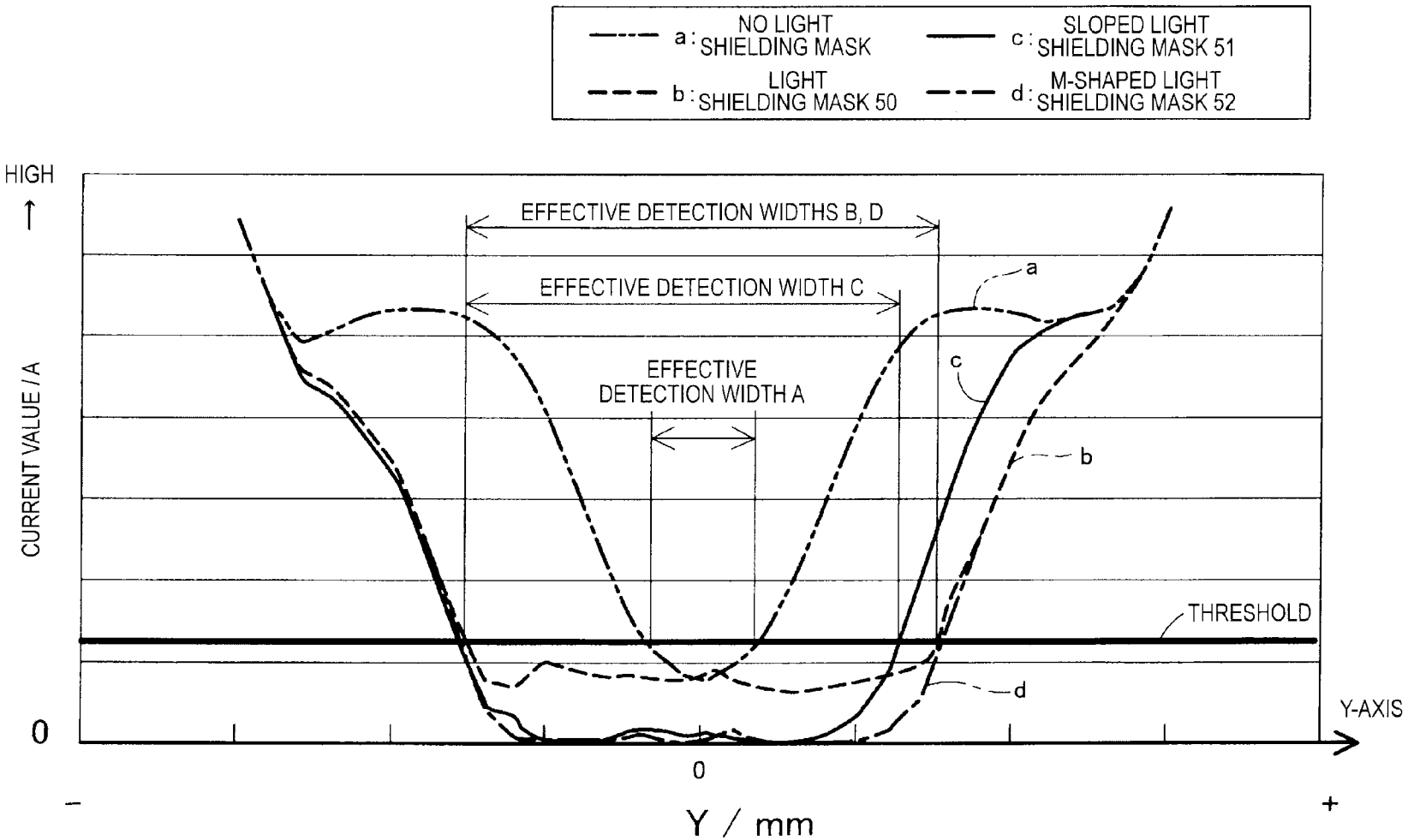
FIG. 8 shows the results of simulating changes in the amount of noise light.

FIG. 8 shows the results of simulating changes in the amount of noise light in the case where the relative positions of the prism 170 and the detection portion 90 change. In FIG. 8, "Y=0" represents the position at which the prism centerline M coincides with the sensor centerline L. In other words, "Y=0" is a state in which the prism 170 and the light emitting element 92 and the light receiving element 94 provided in the detection portion 90 are in the positions of FIG. 7B.

The threshold shown in FIG. 8 is a current value serving as a reference in the printing apparatus 10 in order for the residual amount determination portion 42 to determine the presence of ink IK. The threshold can be appropriately set in the printing apparatus 10. If the current value is greater than the threshold, the residual amount determination portion 42 determines that the ink is near the end, for example, and in the case where the current value is less than or equal to the threshold, the residual amount determination portion 42 determines that there is ink (more than a predetermined value). The effective detection widths shown in FIG. 8 indicate the movement width of the sensor centerline L at which the current values are less than or equal to the threshold. The residual amount determination portion 42 is able to accurately determine that the ink is near the end, in the case where the prism 170 and the detection portion 90 are relatively positioned within the effective detection width. Accordingly, in the case where the determination of whether the ink is near the end is performed while moving the carriage 20 when the effective detection width is wide, the tolerance of the detection range increases with respect to the relative positional shift between the detection portion 90 and the prism 170 in the main scanning direction (Y-axis direction).

A curve a shown in FIG. 8 indicates the current values in the case where the positional relationship between the prism 170 and the detection portion 90 changes as shown in FIGS. 7A, 7B and 7C. An effective detection width A in this case is narrower than effective detection widths B, C and D of curves b, c and d corresponding to embodiments which will be discussed later. One cause for this is the reception of noise light over a wide range from the bottom surface of the prism 170 and the cavity portion 171. In view of this, in the present embodiment, a light shielding mask 50 is provided in the carriage 20, in order to suppress such noise light. Hereafter, the light shielding mask 50 will be described.

Figure 9:
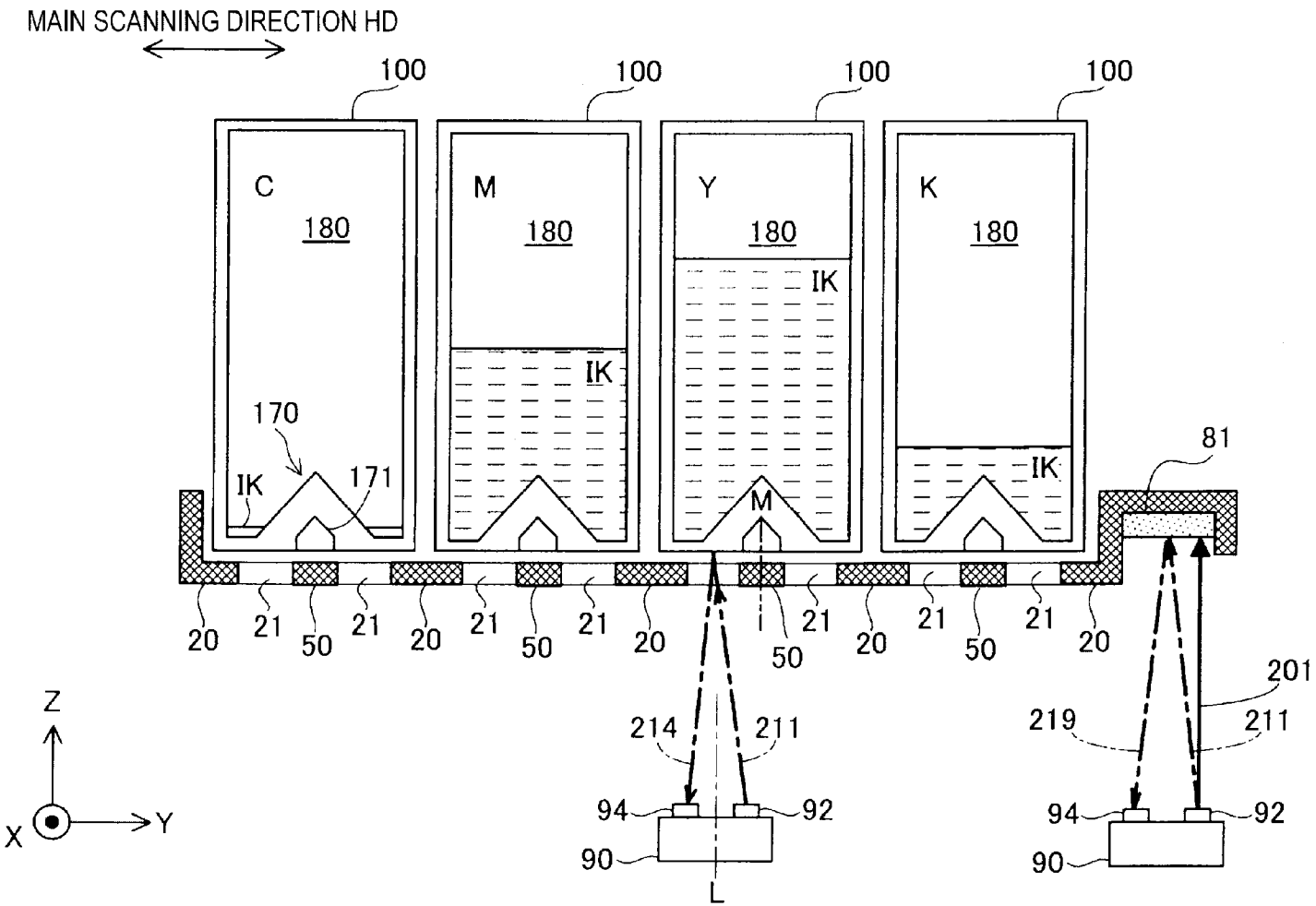
FIG. 9 is a schematic diagram showing a carriage provided with a light shielding mask.

A-4. Configuration of Carriage Provided With Light Shielding Mask:

FIG. 9 is a schematic diagram showing the carriage 20 provided with light shielding mask 50. FIG. 9 schematically shows a cross-sectional view sectioned in an YZ plane where the prism 170 in the ink chamber 180 of the ink cartridge 100 is disposed.

Figure 10:
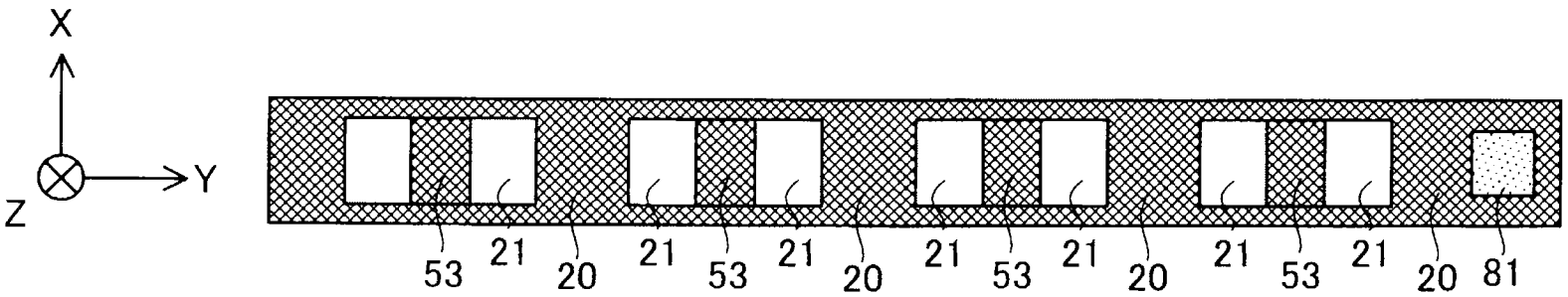
FIG. 10 is a schematic diagram showing a vicinity of openings in the carriage as seen from the detection portion side.

In the carriage 20, openings 21 formed in a bottom surface portion of the carriage 20 are provided. FIG. 10 is a schematic diagram showing a vicinity of the openings 21 in the carriage 20 as seen from the detection portion 90 side. The openings 21 are provided in locations (directly above the Y-axis) opposed to the light emitting element 92 and the light receiving element 94 provided in the detection portion 90 when the prism 170 is positioned directly above the detection portion 90 as a result of the reciprocation of the carriage 20.

In the carriage 20, the light shielding mask 50 that divides the openings 21 in a direction parallel to the ridge line of the prism 170 is provided. The light shielding mask 50 blocks off part of the openings 21 per ink cartridge 100, and the bottom surface of the light shielding mask 50 is parallel to the XY plane. Also, the light shielding mask 50 covers part of the bottom surface of the prism, and is provided in the approximate center of each of the openings 21 corresponding to the positions at which the ink cartridges 100 are fitted to the carriage 20. In the present embodiment, the light shielding mask 50 is formed integrally with the carriage 20. The width of the light shielding mask 50 in the Y direction is greater than the width of the cavity portion 171 in the Y direction. The material of the light shielding mask 50 absorbs light, unlike the material of the prism 170, and in the present embodiment is constituted by polystyrene that has been colored black. Accordingly, when compared with the noise light resulting from reflection by the bottom of the prism 170 and the cavity portion 171, the amount of noise light resulting from reflection by the light shielding mask 50 is very small. Note that the light shielding mask 50 is equivalent to the "light shielding portion" of the present application.

The carriage 20 is further provided with a fault detection plate 81 for detecting whether the detection portion 90 is operating normally. In the present embodiment, the fault detection plate 81 is formed by a mirror that reflects incident light. Light that is incident perpendicularly on the fault detection plate 81 from the light emitting element 92 when the fault detection plate 81 is positioned directly above the detection portion (light path 201) is not incident on the light receiving element 94 because of being totally reflected by the location at which it is incident. On the other hand, part of light irradiated by the light emitting element 92 having the light path 211 is incident on the light receiving element 94 (light path 219) after being reflected by the fault detection plate 81. Note that the fault detection plate 81 is equivalent to the "reflection plate" of the present application.

The sensor fault detection portion 44, having moved the fault detection plate 81 provided in the carriage over the detection portion 90, detects malfunction of the detection portion 90, based on the light incident on the light receiving element 94. Specifically, the sensor fault detection portion 44 moves the carriage 20 at a predetermined timing so that the fault detection plate 81 is positioned directly above the detection portion 90, and causes the fault detection plate 81 to be irradiated with light by the light emitting element 92. The sensor fault detection portion 44 judges that a malfunction has occurred in the detection portion 90, in the case where the current value based on the amount of light that is incident on the light receiving element 94 provided in the detection portion 90 falls below a predetermined current value (e.g., in the case where sufficient light cannot be received because of the light receiving element 94 being covered in ink mist, or where incident light cannot be reflected because of the fault detection plate being covered in the ink mist). Also, the sensor fault detection portion 44 judges that a malfunction has occurred in the detection portion, in the case where the current value based on the amount of light that is incident on the light receiving element 94 increases above a predetermined current value (e.g., in the case where a malfunction has occurred in the electrical circuitry of the detection portion 90). In such cases, the sensor fault detection portion 44 displays or outputs an instruction or information for displaying information prompting repair of the detection portion 90, cleaning of the fault detection plate 81 or the like on the display panel 70 connected to the control unit 40 or the display screen of the computer 60 connected to the printing apparatus 10 via the interface 72. In this way, light (light path 211) that is not necessary when determining whether the residual amount of ink IK is greater than a predetermined amount or less than or equal to a predetermined amount can be used for determining malfunction of the detection portion 90.

Figures 11A, 11B, 11C:
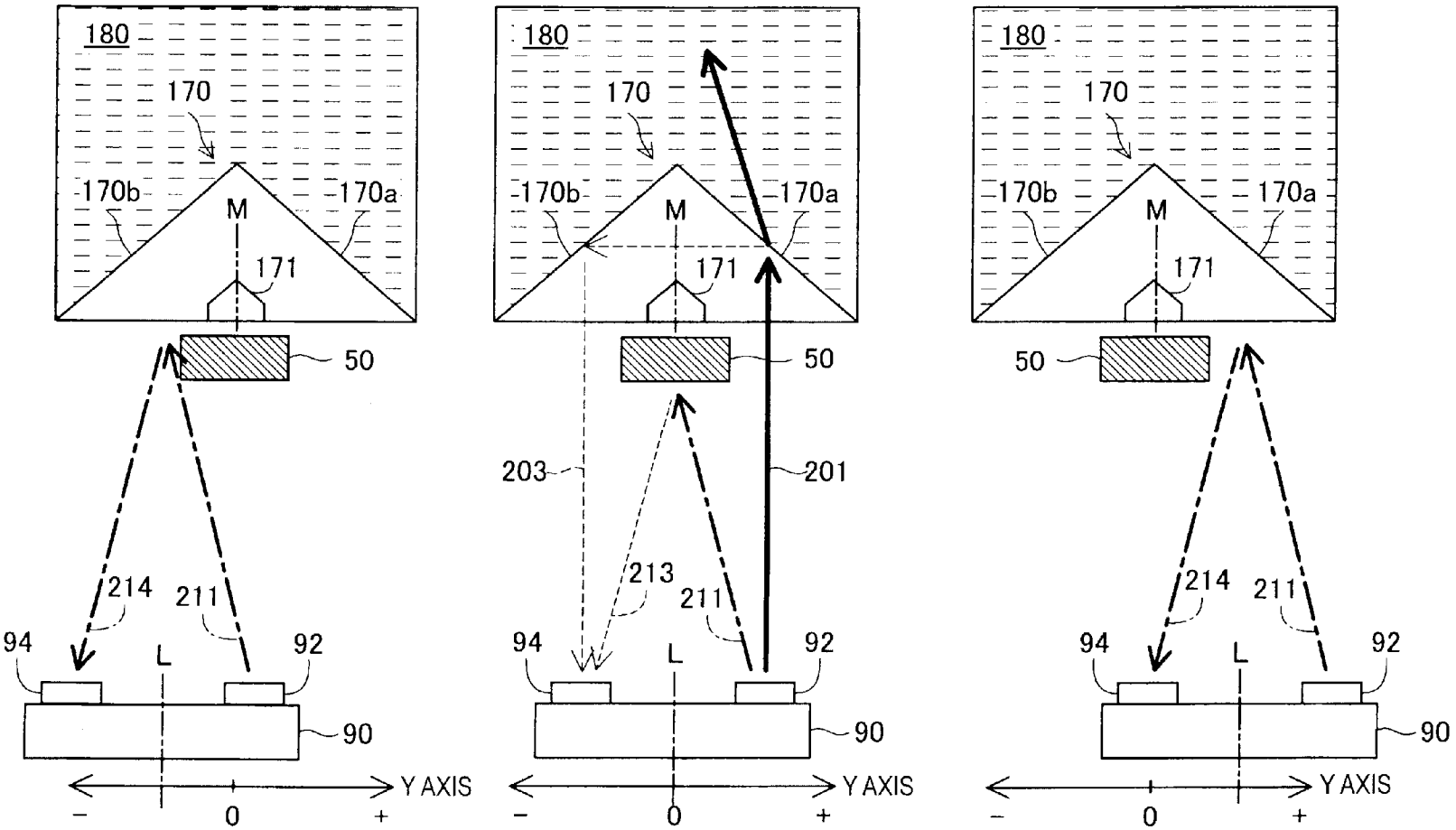
FIGS. 11A to 11C show noise light in the case where the carriage is provided with a light shielding mask.

FIGS. 11A to 11C show noise light in the case where the carriage 20 is provided with the light shielding mask 50. Since the light 211 ejected from the light emitting element 92 is blocked by the light shielding mask in the case where the sensor centerline L is on the inner side of the light shielding mask 50, as shown in FIG. 11B, hardly any noise light is incident on the light receiving element 94. Although the light 211 ejected from the light emitting element 92 is incident on the light receiving element 94 after being reflected by the light shielding mask 50 (light path 213), the amount of incident light is very small when compared with light reflected by the bottom surface of the prism 170 or the cavity portion 171 (e.g., light path 214). Noise light having the light path 214 is also not incident on the light receiving element 94, in the case where part of the light ejected from the light emitting element 92 (light path 211) or light reflected by the prism bottom surface 170 or the cavity portion 171 (light path 214) is blocked by a side wall of the light shielding mask 50. When the sensor centerline L is positioned where the light 211 ejected from the light emitting element 92 is not blocked by the light shielding mask 50 on the minus side of the light shielding mask 50, as shown in FIG. 11A, reflected light from the bottom surface of the prism 170 (light path 214) is incident on the light receiving element 94 as noise light. Also, when the sensor centerline L is positioned where light reflected by the prism bottom surface 170 or the cavity portion 171 (light path 214) is no longer blocked by the side wall of the light shielding mask 50 on the plus side of the light shielding mask 50, as shown in FIG. 11C, reflected light from the bottom surface of the prism 170 (light path 214) will be incident on the light receiving element 94.

The result of simulating the effective detection width in the case where such a light shielding mask 50 is provided is shown in FIG. 8 with the curve b. The effective detection width B in the case where the light shielding mask 50 is provided is wide, when compared with the effective detection width A in the case where the light shielding mask 50 is not provided. This is because the range over which reflected light from the bottom surface of the prism 170 (light path 214) is not incident on the light receiving element 94 (the sensor centerline L being more on the plus side than in FIG. 11A and more on the minus side than in FIG. 11C) increases as a result of using the light shielding mask 50. Also, the current values in the effective detection width B are low compared with the current values in the effective detection width A. This is because in the case where the sensor centerline L is positioned more on the plus side than in FIG. 11A and more on the minus side than in FIG. 11C, only comparatively weak reflected light from the light shielding mask 50 (light path 213) will be incident on the light receiving element 94. Accordingly, in the case of the printing apparatus 10 provided with the light shielding mask 50, noise light can be reduced and the residual state of ink can be more accurately detected than in the case where there is no light shielding mask 50. Problems such as replacement of an ink cartridge 100 being requested despite sufficient ink IK for use in printing still remaining in the ink cartridge 100 or the ink head being damaged due to ink discharge operation being continually performed even though there is no ink IK can thereby be avoided. Also, since the light shielding mask 50 is formed integrally with the carriage 20, the light shielding mask 50 will not shift in position relative to the carriage 20 even when the carriage 20 moves. Accordingly, more accurate detection of the residual state of ink is possible, without needing to align the carriage 20 and the light shielding mask 50. Furthermore, because the residual state of ink can be determined by providing the light shielding mask 50, without using a comparatively expensive light emitting element having an acute directivity angle, costs related to production of the printing apparatus 10 are reduced.

Figures 12A, 12B, 12C:
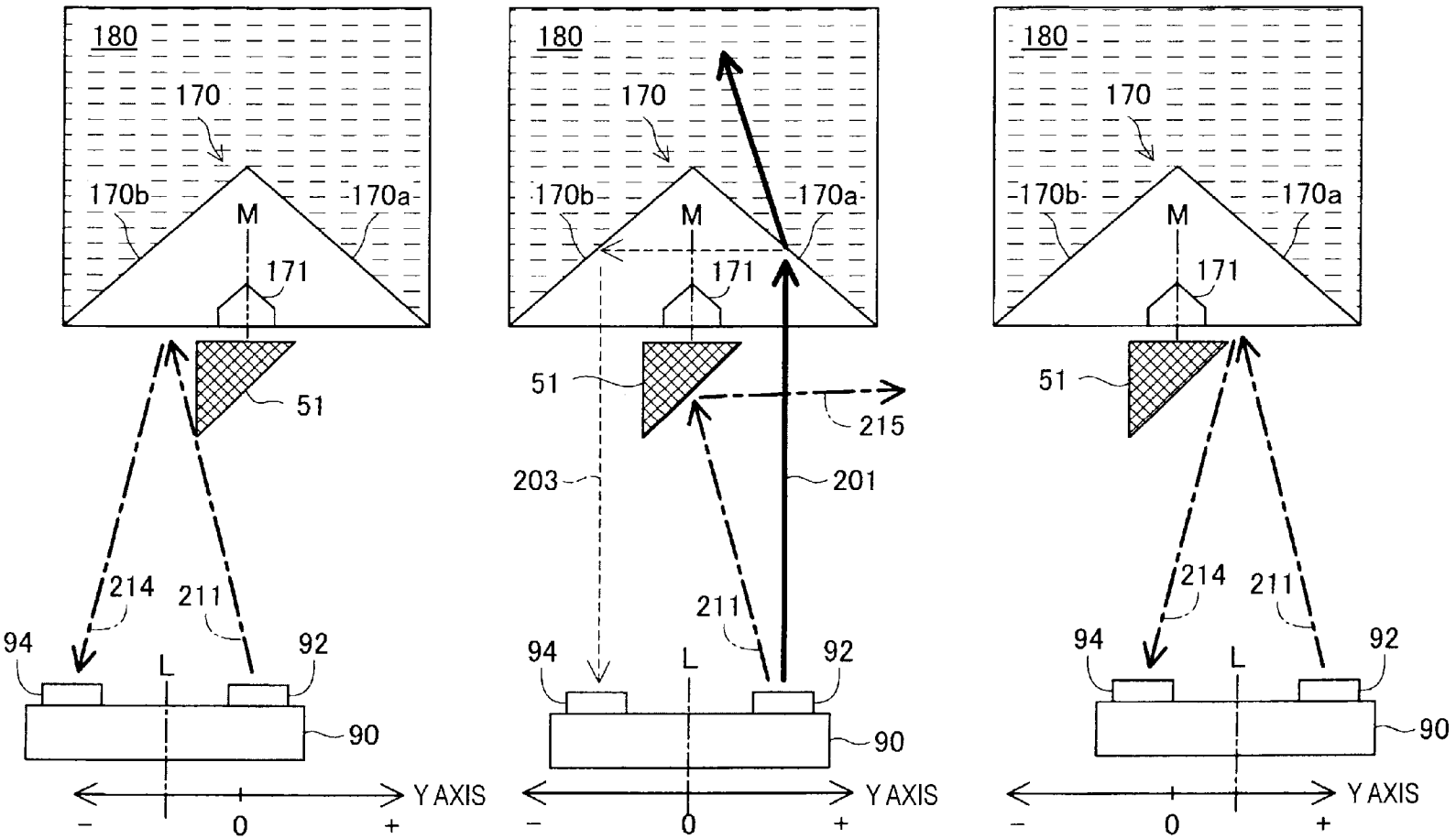
FIGS. 12A to 12C show noise light in the case where the carriage is provided with a sloped light shielding mask.

B. Second Embodiment:

In the first embodiment, the bottom surface of the light shielding mask 50 (surface of the light shielding mask 50 that opposes the detection portion 90) is configured as a planar surface (surface perpendicular to the −Z direction). In contrast, in the second embodiment the case where the bottom surface of the light shielding mask slopes will be described. FIGS. 12A to 12C show noise light in the case where the carriage 20 is provided with a sloped light shielding mask 51. The sloped light shielding mask 51 inclines toward the bottom surface on the light emitting element 92 side, in the case where the sensor centerline L and the prism centerline M are aligned, as shown in FIGS. 12A to 12C. The horizontal width of the sloped light shielding mask 51 relative to the Y-axis and the vertical width relative to the prism centerline M are the same as the light shielding mask 50 of the first embodiment. The inclination angle of the bottom surface of the sloped light shielding mask 51 is 45 degrees in the present embodiment. Specifically, the surface of the sloped light shielding mask 51 that opposes the detection portion 90 forms an angle of 45 degrees with the Y-axis. The bottom surface of the sloped light shielding mask 51 is equivalent to the "sloped surface" of the present application.

In the case where the sensor centerline L is on the inner side of the sloped light shielding mask 51, as shown in FIG. 12B, hardly any noise light is incident on the light receiving element 94, since the light 211 ejected from the light emitting element 92 is blocked by the sloped light shielding mask 51, similarly to the case where the light shielding mask 50 of the first embodiment is provided. The light 211 ejected from the light emitting element 92 is reflected by the sloped surface of the sloped light shielding mask 51 in a different direction (light path 215) from the direction in which light is incident on the light receiving element 94. Noise light having the light path 214 is also not incident on the light receiving element 94, in the case where the light ejected from the light emitting element 92 (light path 211) is blocked by a side wall of the sloped light shielding mask 51. When the sensor centerline L is positioned where the light 211 ejected by the light emitting element 92 is not blocked by the sloped light shielding mask 51 on the minus side of the sloped light shielding mask 51, as shown in FIG. 12A, reflected light from the bottom surface of the prism 170 (light path 214) is incident on the light receiving element 94 as noise light. Also, because the reflected light from the bottom surface of the prism 170 (light path 214) is no longer blocked by the sloped light shielding mask 51 when the sensor centerline L is positioned on the plus side of the sloped light shielding mask 51, as shown in FIG. 12C, this reflected light will be incident on the light receiving element 94.

The result of simulating the effective detection width in the case where the sloped light shielding mask 51 is provided is shown in FIG. 8 with the curve c. The effective detection width C in the case where the sloped light shielding mask 51 is provided is wide, when compared with the effective detection width A in the case where the sloped light shielding mask 51 is not provided. This is because the range over which reflected light from the bottom surface of the prism 170 (light path 214) is not incident on the light receiving element 94 (the sensor centerline L being more on the plus side than in FIG. 12A and more on the minus side than in FIG. 12C) increases as a result of using the sloped light shielding mask 51. Also, the current values in the effective detection width C are low compared with the current values in the effective detection width B of the first embodiment. This is because in the case where the sensor centerline L is positioned more on the plus side than in FIG. 12A and more on the minus side than in FIG. 12C, light irradiated by the light emitting element 92 (light path 211) is reflected by the sloped surface of the sloped light shielding mask 51 in a different direction (light path 215) from the direction in which light is incident on the light receiving element 94. Thus, in a printing apparatus 10 provided with such a sloped light shielding mask 51, comparison with the threshold is facilitated and whether the ink is near the end can be judged with accuracy. Accordingly, because noise light can be further reduced merely by providing a slope on the bottom surface of the light shielding mask, a greater effect can be obtained with a simple design change.

Note that the effective detection width C is asymmetrical with respect to "Y=0", with the effective detection width on the plus side being narrower than the effective detection width on the minus side. This is because the sloped surface of the sloped light shielding mask 51 faces the light emitting element 92 side as shown in FIGS. 12A to 12C, and the position at which reflected light from the bottom surface of the prism 170 (light path 214) will be incident on the light receiving element 94 (FIG. 12C) is closer to the cavity portion 171 of the prism 170 compared with the light shielding mask 50 (FIG. 11C).

C. Third Embodiment:

In the second embodiment, the bottom surface of the light shielding mask is configured as a sloped surface inclining toward the bottom surface on the light emitting element 92 side, in the case where the sensor centerline L and the prism centerline M are aligned. In contrast, in the third embodiment a light shielding mask having two sloped surfaces that are symmetrical around a direction intersecting the direction in which the carriage moves will be described.

Figures 13A, 13B, 13C:
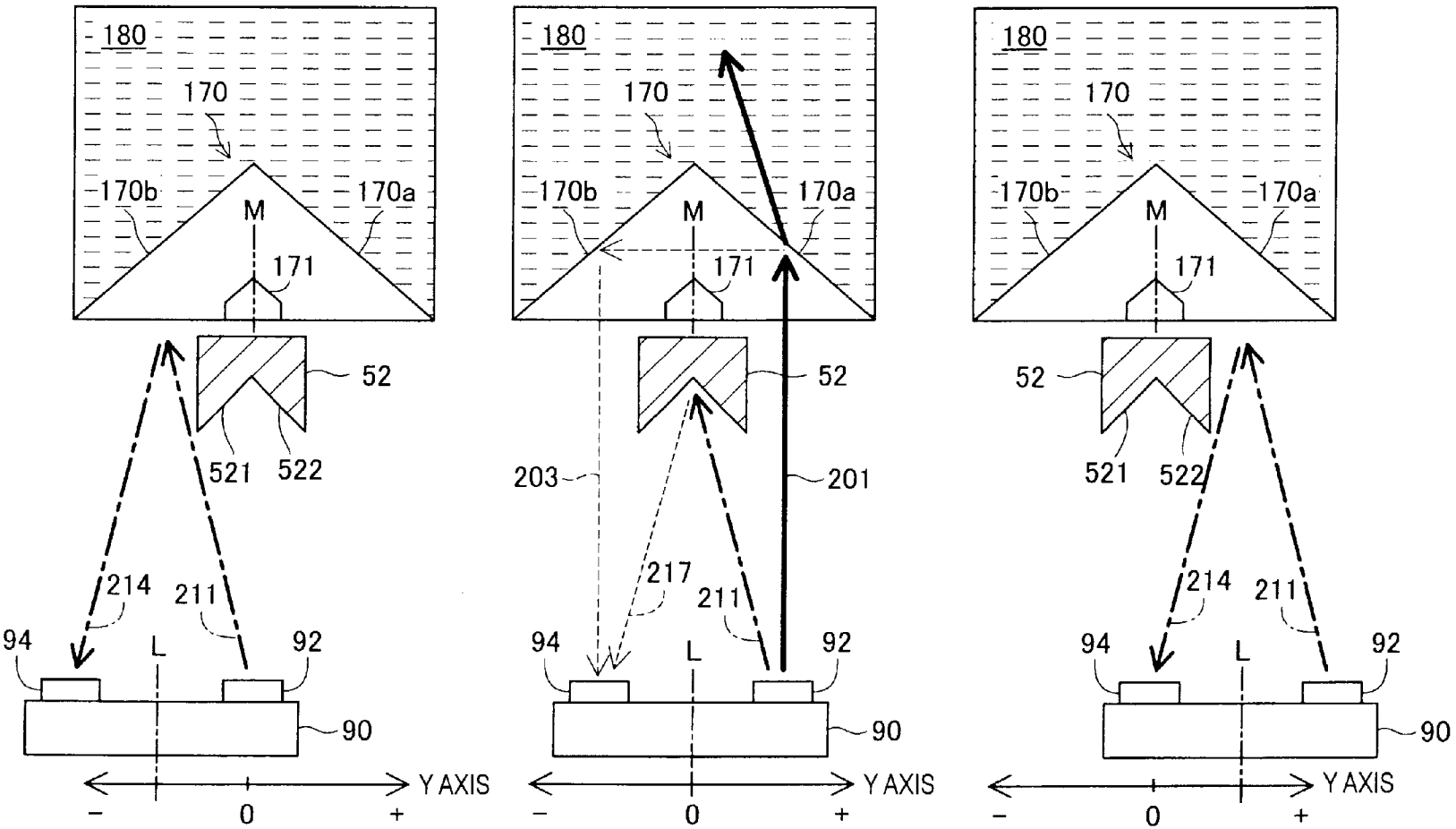
FIGS. 13A to 13C show noise light in the case where the carriage is provided with an M-shaped light shielding mask.

FIGS. 13A to 13C show noise light in the case where the carriage 20 is provided with an M-shaped light shielding mask 52. The M-shaped light shielding mask 52 has two sloped surfaces 521 and 522 that respectively slope inwards on the side that opposes the light emitting element and the light receiving element 94 provided in the detection portion 90 as shown in FIGS. 13A to 13C. The angle of the two sloped surfaces is each 45 degrees in the present embodiment. Also, the bottom surface of the M-shaped light shielding mask 52 has a symmetrical shape with respect to a plane formed by the ridge line of the prism 170 and the prism centerline M. The horizontal width of the M-shaped light shielding mask 52 relative to the Y-axis and the vertical width relative to the prism centerline M are the same as the light shielding mask 50 of the first embodiment and the sloped light shielding mask 51 of the second embodiment.

In the case where the sensor centerline L is on the inner side of the M-shaped light shielding mask 52, as shown in FIG. 13B, hardly any noise light is incident on the light receiving element 94, since the light 211 ejected by the light emitting element 92 is blocked by the M-shaped light shielding mask 52, similarly to the above-mentioned cases where the light shielding mask 50 of the first embodiment and the sloped light shielding mask 51 of the second embodiment are provided. The light 211 ejected by the light emitting element 92 is reflected by each of the sloped surfaces 521 and 522 of the M-shaped light shielding mask 52, and is also reflected in a different direction from the direction in which light is incident on the light receiving element 94, similarly to the case where the sloped light shielding mask 51 of the second embodiment is provided. Accordingly, the amount of reflected light from the M-shaped light shielding mask 52 that is incident on the light receiving element 94 (light path 217) is very small. Noise light having the light path 214 is also not incident on the light receiving element 94, in the case where the light ejected by the light emitting element 92 (light path 211) is blocked by a side wall of the M-shaped light shielding mask 52.

When the sensor centerline L is positioned where the light 211 ejected by the light emitting element 92 is not blocked by the M-shaped light shielding mask 52 on the minus side of the M-shaped light shielding mask 52, as shown in FIG. 13A, reflected light from the bottom surface of the prism 170 (light path 214) is incident on the light receiving element 94 as noise light. Also, when the sensor centerline L is positioned where light reflected by the prism bottom surface 170 or the cavity portion 171 (light path 214) is no longer blocked by the M-shaped light shielding mask 52 on the plus side of the M-shaped light shielding mask 52, as shown in FIG. 13C, reflected light from the bottom surface of the prism 170 (light path 214) will be incident on the light receiving element 94.

The result of simulating the effective detection width in the case where the M-shaped light shielding mask 52 is provided is shown in FIG. 8 with the curve d. The effective detection width D in the case where the M-shaped light shielding mask 52 is provided is wide, when compared with the effective detection width A when there is no light shielding mask. This is because the range over which reflected light from the bottom surface of the prism 170 (light path 214) is not incident on the light receiving element 94 (the sensor centerline L being more on the plus side than in FIG. 13A and more on the minus side than in FIG. 13C) increases as a result of using the M-shaped light shielding mask 52. Accordingly, in a printing apparatus 10 provided with such an M-shaped light shielding mask 52, noise light can be reduced and the residual state of ink can be more accurately detected than in the case where there is no M-shaped light shielding mask 52. Also, the current values in the effective detection width D are low compared with the current values in the effective detection width B of the first embodiment. This is because in the case where the sensor centerline L is positioned more on the plus side than in FIG. 13A and more on the minus side than in FIG. 13C, light irradiated by the light emitting element 92 (light path 211) is also reflected by the two sloped surfaces of the M-shaped light shielding mask 52 in a different direction from the direction in which light is incident on the light receiving element 94. Accordingly, in the printing apparatus 10 provided with the M-shaped light shielding mask 52, comparison with the threshold is facilitated and whether the ink is near the end can be judged with accuracy to a greater extent than the printing apparatus 10 provided with the light shielding mask 50 of the first embodiment. Furthermore, unlike the effective detection width C of the second embodiment, the effective detection width D has a width that is symmetrical around a numerical value 0 of the Y-axis (Y=0). This is because the M-shaped light shielding mask 52 has a symmetrical shape with respect to a plane formed by the ridge line of the prism 170 and the prism centerline M, unlike the sloped light shielding mask 51. Accordingly, the determination of whether the ink is near the end can be performed with sufficient accuracy, even if the prism centerline M of the ink cartridge 100 and the sensor centerline L between the light emitting element 92 and the light receiving element 94 provided in the detection portion 90 are not accurately aligned, compared with the printing apparatus 10 provided with the sloped light shielding mask 51. Thus, setting of the detectable range of the residual state is facilitated, and design flexibility of the printing apparatus 10 can be enhanced.

D. Modifications:

Although various embodiments of the invention are described above, the invention is not limited to these embodiments, and can adopt various configurations that do not depart from the gist thereof. For example, the following modifications are possible.

Figure 14:
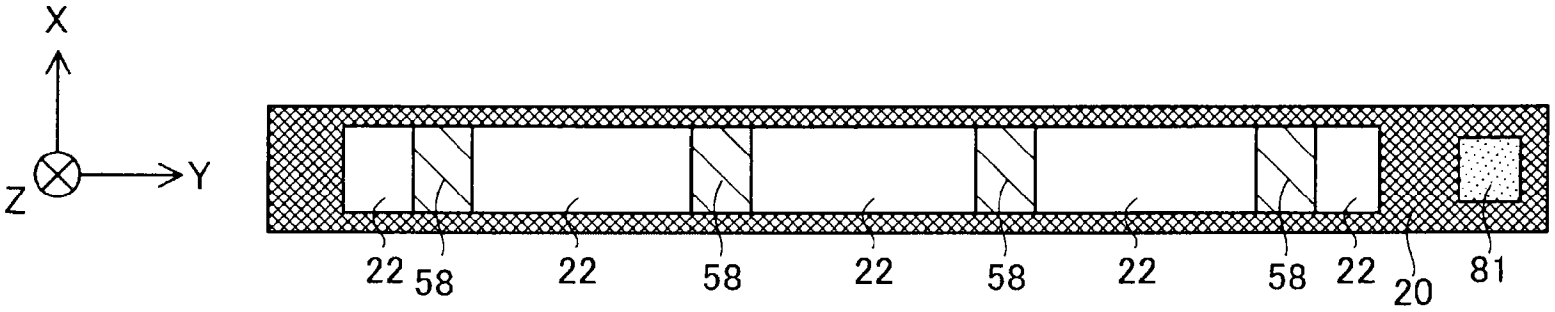
FIG. 14 is a schematic diagram showing an opening integrally provided in the undersurface of the carriage as seen from the detection portion side.

The light shielding mask 50, although formed integrally with the carriage 20 in the above-mentioned embodiments, does not necessarily need to be formed integrally. For example, a member that shields light may be attached to the carriage 20 or the printing apparatus 10, so that a light shielding mask is positioned between the openings 21 in the carriage 20 and the detection portion 90. Also, the openings 21 need not be formed per ink cartridge 100. FIG. 14 is a schematic diagram showing an opening 22 provided integrally on the undersurface of the carriage 20 as seen from the detection portion 90 side. Light shielding masks 58 are disposed between the opening 22 and the detection portion 90. Even in the case of such an opening 22, noise light from the prism 170 or the cavity portion 171 can be suppressed by disposing the light shielding masks 58. The light shielding masks 58 are not limited to the disposition method shown in FIG. 14, and can be appropriately set in locations for suppressing noise light from the prism 170 or the cavity portion 171.

The fault detection plate 81, although formed with a mirror that reflects the incident light 211 in the above-mentioned embodiments, may be formed by coating part of the carriage 20 with a reflective material.

Although the cavity portion 171 is provided in the prism 170 in the above-mentioned embodiments, the cavity portion 171 need not be provided.

Figure 15:
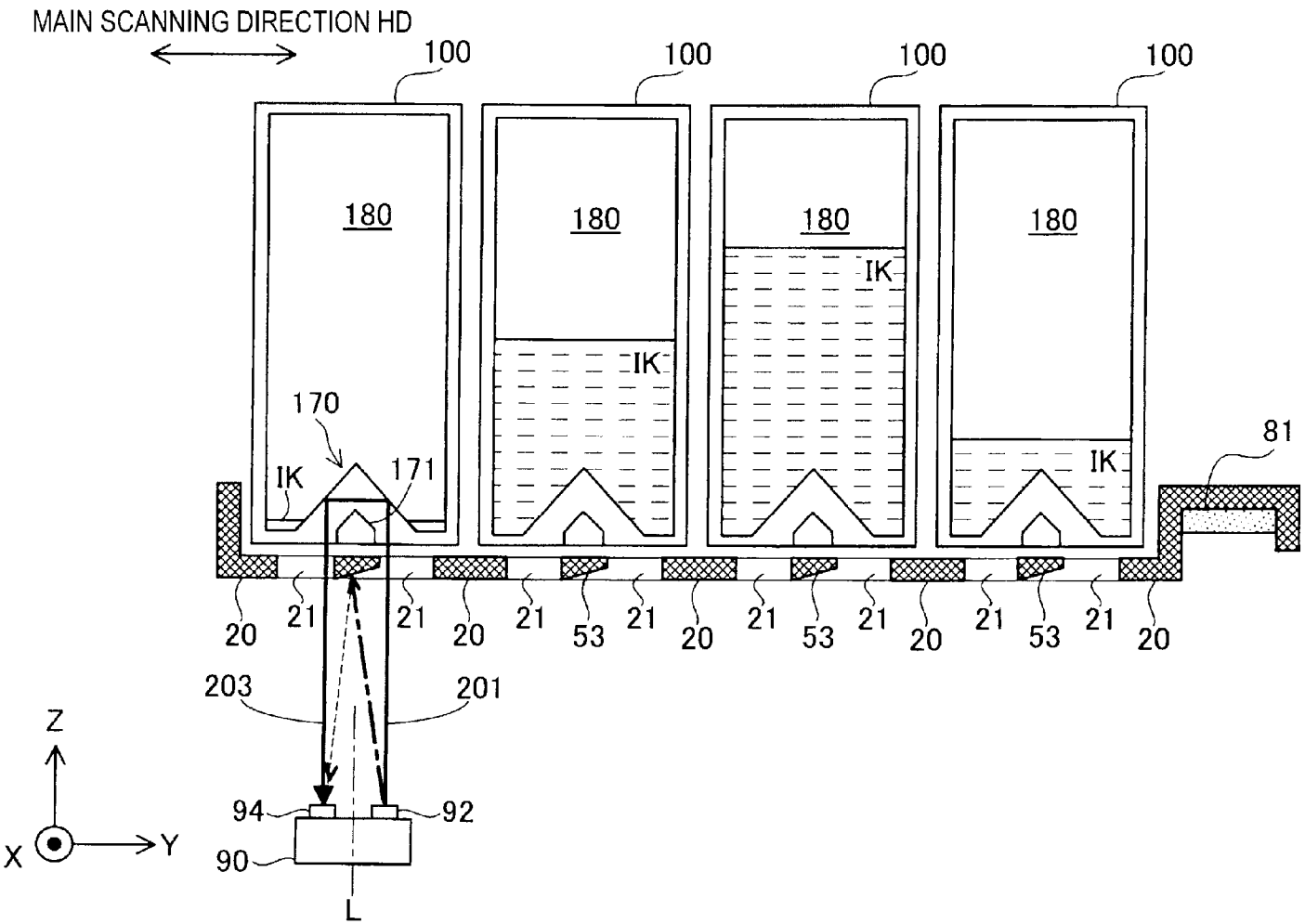
FIG. 15 shows another example of a sloped light shielding mask.

The inclination angle of the sloped surface of the sloped light shielding mask 51 is not limited to the angle indicated in the above-mentioned embodiments. FIG. 15 shows another example of a sloped light shielding mask. A sloped light shielding mask 53 shown in FIG. 15 slopes at approximately 20 degrees toward the light emitting element 92 side. The inclination angle of the sloped surface can be set to any arbitrary angle that enables reflection from the bottom surface of the light shielding mask 50 to be suppressed.

Figure 16:
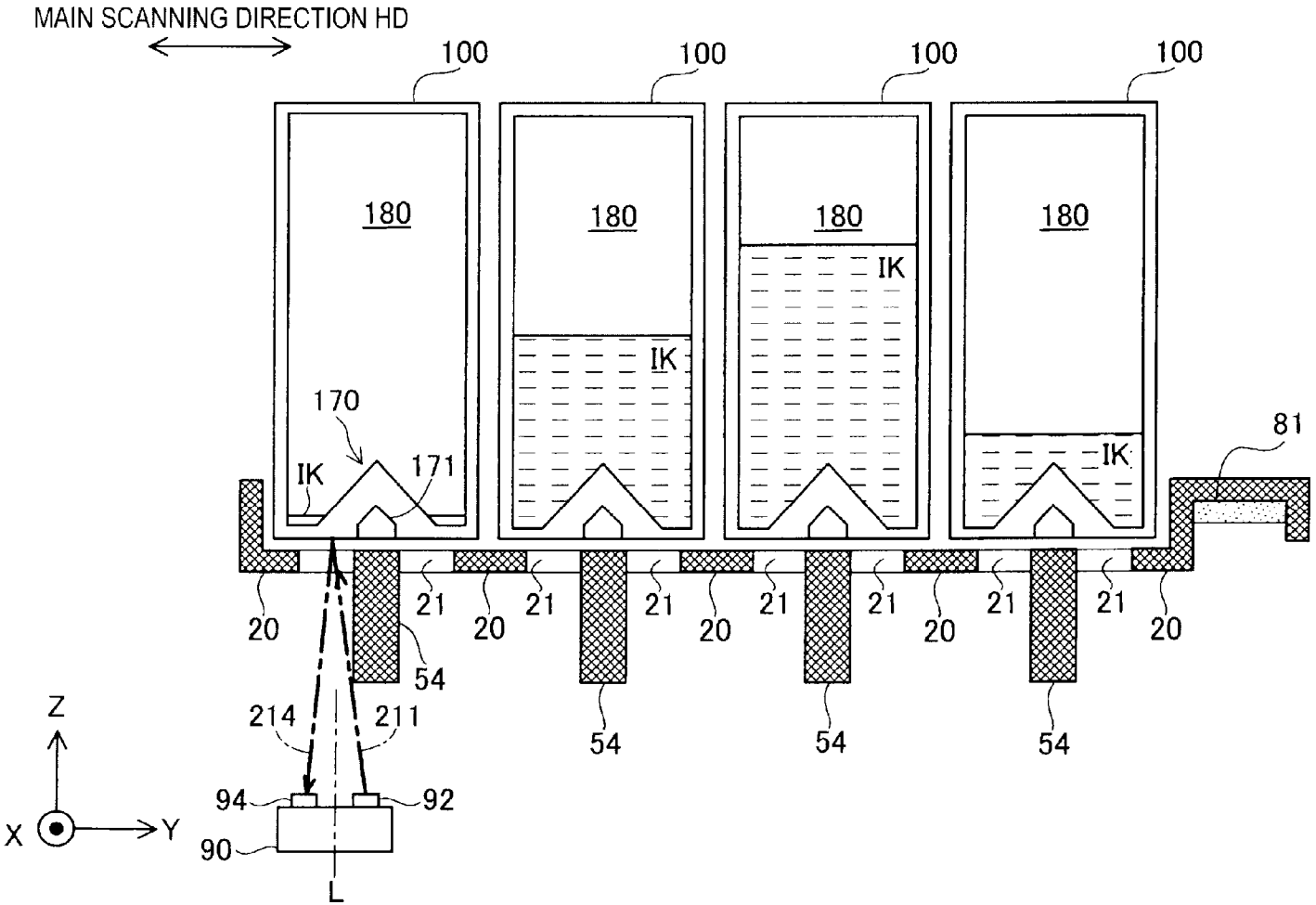
FIG. 16 shows light shielding masks protruding toward the detection portion from the bottom surface of the carriage.

The light shielding mask 50 may protrude toward the detection portion 90 from the bottom surface of the carriage 20, in a range that does not interfere with the reciprocation of the carriage 20. FIG. 16 shows a light shielding mask 54 that protrudes toward the detection portion 90 from the bottom surface of the carriage 20. With such a light shielding mask 54, the effective detection width can be further increased, because the range over which reflected light from the bottom surface of the prism 170 (e.g., light path 214 shown in FIG. 16) can be blocked out by the side walls of the light shielding mask 54 increases compared with the light shielding mask 50 that does not protrude from the carriage 20.

Figure 18:
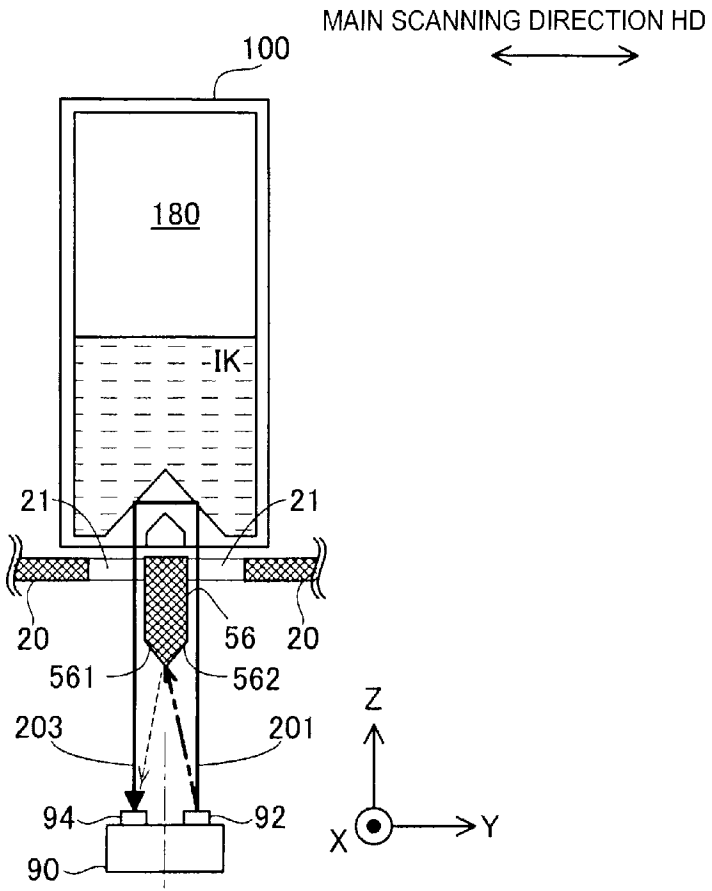
FIG. 18 shows an example of a light shielding mask whose bottom portion slopes symmetrically outwards.
Figure 17:
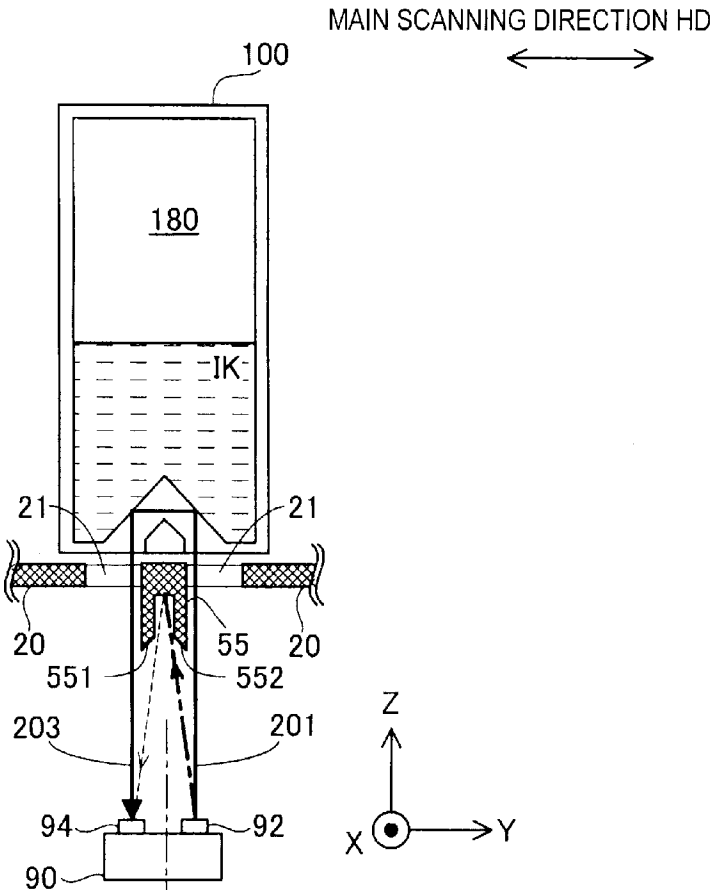
FIG. 17 shows an example of a light shielding mask in which a recessed hollow is provided at a boundary portion between sloped surfaces that each slopes inwards.

The bottom surface portion of the light shielding mask can also employ a symmetrical shape that differs from the M-shaped light shielding mask 52. FIG. 17 shows an example of a light shielding mask 55 that is provided with a recessed hollow in the boundary portion of sloped surfaces 551 and 552 that each slopes inwards. Also, FIG. 18 shows an example of a light shielding mask 56 provided with sloped surfaces 561 and 562 whose bottom surface portion slopes symmetrically outwards. Even with such light shielding masks 55 and 56, a symmetrical effective detection width can be obtained around a numerical value 0 of the Y-axis (Y=0), similarly to the third embodiment.

Although the ink residual state is measured as a result of the carriage 20 reciprocating over the detection portion 90 in the above-mentioned embodiments, a configuration may be adopted in which the detection portion 90 reciprocates. In other words, the detection portion 90 and the carriage 20 can reciprocate relatively.

Figure 19:
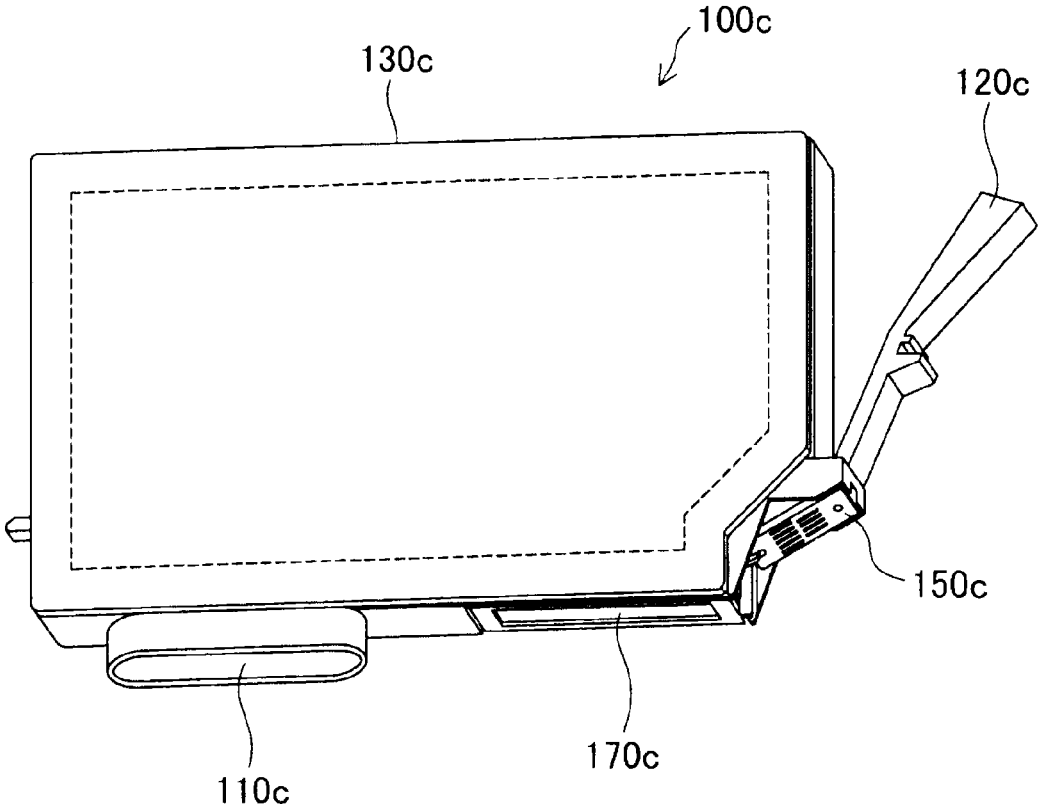
FIG. 19 is a perspective diagram showing another configuration of an ink cartridge.

It is also possible to employ ink cartridges having other arbitrary configurations apart from the ink cartridge 100 shown in the above-mentioned embodiments. FIG. 19 is a perspective diagram showing another configuration of the ink cartridge 100. A substrate 150*c* may be attached to an ink housing portion 130*c* of the ink cartridge 100*c* at an incline. Also, a prism 170*c* may be provided on a lever 120*c* side. Also, an ink feeding port 110*c* may be sealed by a cap or a film (not shown), or the like.

Although examples in which the invention was applied to an on-carriage type printing apparatus was described in the above-mentioned embodiments, the invention may be used in an off-carriage type printing apparatus. In the off-carriage type printing apparatus, ink cartridges are not provided on carriage having printing head 22 and are attached to an ink cartridge holder fixed to the printing apparatus. In this case, the detection portion is provided on carriage and face the prism on ink cartridge with carriage movement by the carriage motor 33. The ink cartridge holder has the opening provided in a position that opposes the prism when the ink cartridge is attached and has the light shielding portion.

Although examples in which the invention was applied to a printing apparatus and an ink cartridge were described in the above-mentioned embodiments, the invention may be used in a liquid consumption apparatus that sprays or discharges other liquids apart from ink, and is also applicable to a liquid container that houses such a liquid. Also, the liquid container of the invention can be appropriated to various types of liquid consumption apparatus provided with a liquid jet head or the like for discharging minute droplets. "Droplets" refers to the state of a liquid that is discharged from the above liquid consumption apparatus, and is deemed to include discharged liquid that leaves a granular, teardrop-shaped or stringy trail. Also, "liquid" as referred to here may be a material that can be sprayed by a liquid consumption apparatus. For example, the material may be a substance in its liquid phase, and includes not only materials in a liquid state with high or low viscosity, materials in a flow state such as sol, gel water, other inorganic solvents, organic solvents, solutions, liquid resins, liquid metals (metal melts), and liquids serving as one state of a substance, but also materials obtained by dissolving, dispersing or mixing particles of functional materials consisting of solids such pigments or metal particles. Also, ink such as described in the above embodiments, liquid crystal and the like are given as typical examples of liquids. Here, "ink" is deemed to encompass various liquid composites such as gel ink, hot melt ink and the like as well as common water-based ink and oil-based ink. Specific examples of a liquid consumption apparatus include, for example, a liquid consumption apparatus that sprays a liquid including a material, such as an electrode material or a color material used in, for instance, the production of liquid crystal displays, EL (electroluminescence) displays, surface-emitting displays, color filters and the like, in a dispersed or dissolved form, a liquid consumption apparatus that sprays a bioorganic material used in biochip production, and a liquid consumption apparatus that is used as a precision pipette and sprays a liquid serving as a sample. Furthermore, a liquid consumption apparatus that sprays a lubricant with pinpoint accuracy onto a precision instrument such as a clock or a camera, a liquid consumption apparatus that sprays a transparent resin solution such as ultraviolet-curing resin onto a substrate in order to form a hemisphere microlens (optical lens) used in an optical communication device or the like, and a liquid consumption apparatus that sprays an etching solution such as acid or alkali in order to etch a substrate or the like may also be employed.

What is claimed is:

1. A liquid consumption apparatus comprising:

a detection portion having a light emitting portion and a light receiving portion that are substantially aligned;

a liquid container that houses a liquid and has a prism that reflects light irradiated by the light emitting portion toward the light receiving portion according to an amount of the liquid in the liquid container;

a carriage to which the liquid container is detachably attached, and having an opening provided in a position that is opposable to the prism when the liquid container is attached;

a driving portion that moves the carriage in a direction in which the light emitting portion and the light receiving portion are substantially aligned; and a light shielding portion disposed in the opening provided in the carriage, the light shielding portion including a section that divides the opening in a direction intersecting the direction in which the carriage moves;

wherein the prism has a cavity portion in a central portion of a surface that opposes the detection portion, and wherein, with respect to the direction in which the carriage moves, the light shielding portion has a width that is greater than a width of the cavity portion.

2. The liquid consumption apparatus according to claim 1:

wherein the light shielding portion has a sloped surface that opposes the detection portion and slopes toward a bottom surface of the liquid container.

3. The liquid consumption apparatus according to claim 2, wherein the sloped surface of the light shielding portion slopes to the light emitting portion side, when the light shielding portion and the detection portion are opposed to each other.

4. The liquid consumption apparatus according to claim 1:

wherein the light shielding portion has a surface that opposes the detection portion and protrudes toward the detection portion from a surface of the carriage that opposes the detection portion.

5. The liquid consumption apparatus according to claim 2, wherein the light shielding portion has a surface that opposes the detection portion and has at least two sloped surfaces, and the at least two sloped surfaces are symmetrical around a direction intersecting the direction in which the carriage moves.

6. A liquid consumption apparatus comprising:

a detection portion having a light emitting portion and a light receiving portion that are substantially aligned;

a liquid container that houses a liquid and has a prism that reflects light irradiated by the light emitting portion toward the light receiving portion according to an amount of the liquid in the liquid container;

a carriage to which the liquid container is detachably attached, and having an opening provided in a position that opposes the prism when the liquid container is attached;

a driving portion that moves the carriage in a direction in which the light emitting portion and the light receiving portion are substantially aligned; and a light shielding portion disposed in the opening provided in the carriage;

wherein the light shielding portion includes a section that divides the opening in a direction intersecting the direction in which the carriage moves, wherein the carriage includes a reflection plate, and the detection portion irradiates the reflection plate with light using the light emitting portion, receives light reflected by the reflection plate with the light receiving portion, and detects a fault in the detection portion based on the reflected light that is received.

7. The liquid consumption apparatus according to claim 3, wherein the sloped surface is oriented such that light emitted from the light emitting portion is reflected by the sloped surface in a different direction from a direction in which light is incident on the light receiving portion.

8. The liquid consumption apparatus according to claim 3, wherein the sloped surface is farther from the light emitting portion than the light receiving portion in a direction substantially perpendicular to a direction in which the light emitting portion and the light receiving portion are substantially aligned.

9. The liquid consumption apparatus according to claim 1, wherein the liquid container and the prism are separate components.

* * * * *